US008974027B2

(12) United States Patent
Nishioka et al.

(10) Patent No.: US 8,974,027 B2
(45) Date of Patent: Mar. 10, 2015

(54) PRINTING APPARATUS AND PRINTING POSITION ADJUSTING METHOD THEREOF

(75) Inventors: Shingo Nishioka, Yokohama (JP); Akihiro Tomida, Kawasaki (JP); Yoshinori Nakajima, Yokohama (JP); Naoki Uchida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 232 days.

(21) Appl. No.: 13/155,531

(22) Filed: Jun. 8, 2011

(65) Prior Publication Data

US 2012/0001972 A1 Jan. 5, 2012

(30) Foreign Application Priority Data

Jun. 30, 2010 (JP) ..... 2010-150265

(51) Int. Cl.

| | |
|---|---|
| ***B41J 29/38*** | (2006.01) |
| ***B41J 29/393*** | (2006.01) |
| ***B41J 2/015*** | (2006.01) |
| ***B41J 2/21*** | (2006.01) |

(52) U.S. Cl.

CPC ..... *B41J 29/38* (2013.01); *B41J 2/2135* (2013.01); *B41J 29/393* (2013.01)

USPC ..... 347/12; 347/9; 347/19; 347/20

(58) Field of Classification Search

USPC ..... 347/9, 12, 19–20

See application file for complete search history.

(56) References Cited

U.S. PATENT DOCUMENTS

| | | | | |
|---|---|---|---|---|
| 6,092,939 | A | 7/2000 | Nishikori et al. | |
| 6,378,982 | B2 | 4/2002 | Ono et al. | |
| 6,474,779 | B2 | 11/2002 | Inui et al. | |
| 7,789,476 | B2 | 9/2010 | Tomida et al. | |
| 2006/0038842 | A1 * | 2/2006 | Chikuma et al. | 347/12 |
| 2006/0119633 | A1 * | 6/2006 | Hsu et al. | 347/19 |
| 2009/0040263 | A1 | 2/2009 | Tomida et al. | |
| 2009/0160900 | A1 * | 6/2009 | Niida et al. | 347/19 |
| 2009/0195570 | A1 * | 8/2009 | Hayashi | 347/5 |
| 2010/0277539 | A1 | 11/2010 | Tomida et al. | |
| 2010/0309240 | A1 * | 12/2010 | Tomida et al. | 347/12 |
| 2011/0007112 | A1 * | 1/2011 | Takei et al. | 347/37 |
| 2011/0187774 | A1 | 8/2011 | Kakinuma et al. | |

FOREIGN PATENT DOCUMENTS

| | | | |
|---|---|---|---|
| JP | 10-329381 | A | 12/1998 |
| JP | 2006-102997 | A | 4/2006 |
| JP | 2009-039916 | A | 2/2009 |

* cited by examiner

*Primary Examiner* — Jason Uhlenhake

(74) *Attorney, Agent, or Firm* — Fitzpatrick, Cella, Harper & Scinto

(57) ABSTRACT

A printing apparatus prints by discharging inks from respective nozzle arrays, the printhead having a plurality of nozzle arrays including at least a first nozzle array, a second nozzle array, and a third nozzle array, and the first nozzle array and the second nozzle array being arrayed to be shifted in a nozzle arrayed direction. The printing apparatus controls the first and second nozzle arrays to discharge inks to form a plurality of first patterns. The printing apparatus controls the third nozzle array to discharge inks to form second patterns while changing a shift amount in a direction which intersects with the nozzle arrayed direction with respect to the plurality of first patterns. The printing apparatus calculates an adjustment value required to adjust relative printing positions between the first nozzle array and the third nozzle array in the intersecting direction using the first patterns and the second patterns.

12 Claims, 15 Drawing Sheets

FIG. 14

| ADJUSTMENT ORDER | ADJUSTMENT ITEM | REFERENCE PATTERN | | | SHIFTED PATTERN | |
|---|---|---|---|---|---|---|
| | | USE NOZZLE ARRAY | | PRINTING DIRECTION | USE NOZZLE ARRAY | PRINTING DIRECTION |
| 1 | BETWEEN A AND B ARRAYS IN FORWARD DIRECTION | 302K-A | | FORWARD | 302K-B | FORWARD |
| 2 | BETWEEN A AND B ARRAYS IN FORWARD DIRECTION | 302C-A | | FORWARD | 302C-B | FORWARD |
| 3 | BETWEEN A AND B ARRAYS IN FORWARD DIRECTION | 302M-A | | FORWARD | 302M-B | FORWARD |
| 4 | BETWEEN A AND B ARRAYS IN FORWARD DIRECTION | 302Y-A | | FORWARD | 302Y-B | FORWARD |
| 5 | BETWEEN A AND B ARRAYS IN BACKWARD DIRECTION | 302K-A | | BACKWARD | 302K-B | BACKWARD |
| 6 | BETWEEN A AND B ARRAYS IN BACKWARD DIRECTION | 302C-A | | BACKWARD | 302C-B | BACKWARD |
| 7 | BETWEEN A AND B ARRAYS IN BACKWARD DIRECTION | 302M-A | | BACKWARD | 302M-B | BACKWARD |
| 8 | BETWEEN A AND B ARRAYS IN BACKWARD DIRECTION | 302Y-A | | BACKWARD | 302Y-B | BACKWARD |
| 9 | BETWEEN FORWARD AND BACKWARD SCANS | 302K-A | 302K-B | FORWARD | 302K-A | BACKWARD |
| 10 | BETWEEN FORWARD AND BACKWARD SCANS | 302C-A | 302C-B | FORWARD | 302C-A | BACKWARD |
| 11 | BETWEEN FORWARD AND BACKWARD SCANS | 302M-A | 302M-B | FORWARD | 302M-A | BACKWARD |
| 12 | BETWEEN FORWARD AND BACKWARD SCANS | 302Y-A | 302Y-B | FORWARD | 302Y-A | BACKWARD |
| 13 | BETWEEN DIFFERENT COLORS | 302K-A | 302K-B | FORWARD | 302C-A | FORWARD |
| 14 | BETWEEN DIFFERENT COLORS | 302K-A | 302K-B | FORWARD | 302M-A | FORWARD |
| 15 | BETWEEN DIFFERENT COLORS | 302K-A | 302K-B | FORWARD | 302Y-A | FORWARD |

PRINTING APPARATUS AND PRINTING POSITION ADJUSTING METHOD THEREOF

BACKGROUND OF THE INVENTION

1. Field of the Invention

The present invention relates to a printing apparatus and a printing position adjusting method thereof.

2. Description of the Related Art

Printing apparatuses that adopt an ink-jet printing method are known. Such printing apparatus prints an image on a printing medium by discharging inks from orifices arrayed on a printhead while reciprocally moving the printhead.

In recent years, in such printing apparatus, the number of orifices (nozzles) tends to increase so as to increase a printing speed. The printing apparatus includes a printhead having a plurality of orifice arrays (nozzle arrays) in correspondence with a plurality of ink colors, so as to implement color printing.

Under such circumstances, dot printing positions between nozzle arrays are often shifted due to, for example, shifts of nozzle forming position and that of printhead mounting position at the time of manufacture of the printhead. When a plurality of printheads are used, dot printing positions are often shifted due to a relative position shift between the printheads. Furthermore, a single nozzle array often causes shifts of dot printing positions when printing is done in two directions (forward and backward directions).

To solve these problems, printing position adjustment processing for adjusting dot printing positions (also called registration processing) is known. In the registration processing, by selecting one nozzle array as a reference, a relative shift amount of the dot printing positions by another nozzle array with respect to those by that nozzle array is calculated, and ink discharge timings are corrected based on the shift amount. As for shifts of the dot printing positions in forward and backward print scans at the time of bidirectional printing, the registration processing is similarly attained by correcting discharge timings.

In this case, when an adjustment value required to adjust dot printing positions is to be calculated, for example, a plurality of shifted patterns (obtained by shifting printing positions little by little from those of reference patterns) are printed using another nozzle array to overlap the reference patterns printed using a reference nozzle array. Then, a shift amount of ink landing positions of dots is detected based on density changes with respect to a shifting amount of the patterns which are printed to overlap the reference patterns, and the ink landing positions of dots are corrected using this shift amount.

As a method of detecting the shift amount, for example, visual confirmation by the user is known. Note that when the aforementioned adjustment value is calculated at the time of bidirectional printing, the user visually confirms print results obtained by printing a plurality of patterns while shifting discharge timings in a backward scan with respect to a forward scan. The visual confirmation forces troublesome works on the user. Hence, a technique which optically reads adjustment patterns using a sensor, and controls the apparatus to automatically calculate an adjustment value based on the reading result has also been proposed (Japanese Patent Laid-Open No. 10-329381).

In recent years, since a droplet size reduction of an ink to be discharged has progressed for the purpose of improvement of printing quality, disturbances influence heavily on ink discharging and dot printing. The disturbances include, for example, vibrations upon movement of a carriage which mounts a printhead, and posture variations of the printhead upon scanning the carriage due to a distortion of a rail stay which supports the carriage.

Such disturbances cause variations of dot printing positions at the time of printing of adjustment patterns, and may influence formation of patterns used in the registration processing. In order to suppress the influences of these disturbances, a measure such as enhancement of mechanical precision of a printing apparatus may be taken, but it is not desirable in terms of cost.

It is demanded to correctly execute adjustment even when such variations of dot printing positions have occurred. A technique described in Japanese Patent Laid-Open No. 2006-102997 refers to a technique which prints abnormality detection patterns in synchronism with adjustment patterns, and corrects read values of the adjustment patterns influenced by the disturbances at the time of adjustment or executes calculations by excluding the influenced patterns at the time of calculations of the adjustment value. Also, a technique described in Japanese Patent Laid-Open No. 2009-39916 refers to a technique which calculates an adjustment value by interpolation based on tendencies of a plurality of patterns, and changes the number of patterns used in the interpolation by checking whether or not a pattern having a different tendency is included upon execution of the interpolation, thereby reducing the influences of the disturbances.

However, with the techniques described in Japanese Patent Laid-Open Nos. 2006-102997 and 2009-39916, a pattern itself cannot be normally formed due to the disturbances, and a plurality of patterns cannot have intended density changes. For this reason, a problem about an unavoidable certain precision drop remains unsolved.

SUMMARY OF THE INVENTION

The present invention provides a technique which can suppress large density changes of adjustment patterns caused by disturbances even under the influences of the disturbances at the time of formation of the adjustment patterns.

According to a first aspect of the present invention there is provided a printing apparatus which prints by discharging inks from respective nozzle arrays while relatively moving a printhead with respect to a printing medium in a direction which intersects with the nozzle arrayed direction, the printhead comprising a plurality of nozzle arrays including at least a first nozzle array, a second nozzle array, and a third nozzle array, the first nozzle array and the second nozzle array being arrayed to be shifted in a nozzle arrayed direction, and each nozzle belonging to the second nozzle array being arrayed between nozzles belonging to the first nozzle array in the nozzle array direction, the apparatus comprising: a first print control unit configured to control the first nozzle array and the second nozzle array to discharge inks to form a plurality of first patterns on the printing medium; a second print control unit configured to control the third nozzle array to discharge inks to form second patterns on the printing medium while changing a shift amount in the intersecting direction with respect to the plurality of first patterns formed on the printing medium; and a calculation unit configured to calculate an adjustment value required to adjust relative printing positions between the first nozzle array and the third nozzle array in the intersecting direction based on the plurality of first patterns and the second patterns formed on the printing medium.

According to a second aspect of the present invention there is provided a printing apparatus which prints by discharging inks from respective nozzle arrays while relatively and reciprocally moving a printhead with respect to a printing medium in a direction which intersects with the nozzle arrayed direction, the printhead comprising a plurality of nozzle arrays including at least a first nozzle array and a second nozzle array, the first nozzle array and the second nozzle array being arrayed to be shifted in a nozzle arrayed direction, and each nozzle belonging to the second nozzle array being arrayed between nozzles belonging to the first nozzle array in the nozzle array direction, the apparatus comprising: a first print control unit configured to control the first nozzle array and the second nozzle array to discharge inks to form a plurality of first patterns in a relative movement of the printhead in a forward direction; a second print control unit configured to control the first nozzle array to discharge inks to form second patterns while changing a shift amount in the intersecting direction with respect to the plurality of first patterns formed on the printing medium in a relative movement of the printhead in a backward direction; and a calculation unit configured to calculate an adjustment value required to adjust relative printing positions in the relative movement in the forward direction and the relative movement in the backward direction based on the plurality of first patterns and the second patterns formed on the printing medium.

According to a third aspect of the present invention there is provided a printing apparatus which prints by discharging inks from respective nozzle arrays while relatively moving a printhead, which comprises a first nozzle array and a second nozzle array, with respect to a printing medium in a direction which intersects with a nozzle arrayed direction, the apparatus comprising: a first print control unit configured to control the first nozzle array to discharge a plurality of ink droplets to a single position on the printing medium to form a plurality of first patterns on the printing medium; a second print control unit configured to control the second nozzle array to discharge inks to form second patterns on the printing medium while changing a shift amount in the intersecting direction with respect to the plurality of first patterns formed on the printing medium; and a calculation unit configured to calculate an adjustment value required to adjust relative printing positions between the first nozzle array and the second nozzle array in the intersecting direction based on the plurality of first patterns and the second patterns formed on the printing medium.

According to a fourth aspect of the present invention there is provided a printing position adjusting method in a printing apparatus which prints by discharging inks from respective nozzle arrays while relatively moving a printhead with respect to a printing medium in a direction which intersects with the nozzle arrayed direction, the printhead comprising a plurality of nozzle arrays including at least a first nozzle array, a second nozzle array, and a third nozzle array, the first nozzle array and the second nozzle array being arrayed to be shifted in a nozzle arrayed direction, and each nozzle belonging to the second nozzle array being arrayed between nozzles belonging to the first nozzle array in the nozzle array direction, the method comprising: controlling the first nozzle array and the second nozzle array to discharge inks to form a plurality of first patterns on the printing medium; controlling the third nozzle array to discharge inks to form second patterns on the printing medium while changing a shift amount in the intersecting direction with respect to the plurality of first patterns formed on the printing medium; and calculating an adjustment value required to adjust relative printing positions between the first nozzle array and the third nozzle array in the intersecting direction based on the plurality of first patterns and the second patterns formed on the printing medium.

According to a fifth aspect of the present invention there is provided a printing position adjusting method in a printing apparatus which prints by discharging inks from respective nozzle arrays while relatively and reciprocally moving a printhead with respect to a printing medium in a direction which intersects with the nozzle arrayed direction, the printhead comprising a plurality of nozzle arrays including at least a first nozzle array and a second nozzle array, the first nozzle array and the second nozzle array being arrayed to be shifted in a nozzle arrayed direction, and each nozzle belonging to the second nozzle array being arrayed between nozzles belonging to the first nozzle array in the nozzle array direction, the method comprising: controlling the first nozzle array and the second nozzle array to discharge inks to form a plurality of first patterns in a relative movement of the printhead in a forward direction; controlling the first nozzle array to discharge inks to form second patterns while changing a shift amount in the intersecting direction with respect to the plurality of first patterns formed on the printing medium in a relative movement of the printhead in a backward direction; and calculating an adjustment value required to adjust relative printing positions in the relative movement in the forward direction and the relative movement in the backward direction based on the plurality of first patterns and the second patterns formed on the printing medium.

According to a sixth aspect of the present invention there is provided a printing position adjusting method in a printing apparatus which prints by discharging inks from respective nozzle arrays while relatively moving a printhead, which comprises a first nozzle array and a second nozzle array, with respect to a printing medium in a direction which intersects with a nozzle arrayed direction, the method comprising: controlling the first nozzle array to discharge a plurality of ink droplets to a single position on the printing medium to form a plurality of first patterns on the printing medium; controlling the second nozzle array to discharge inks to form second patterns on the printing medium while changing a shift amount in the intersecting direction with respect to the plurality of first patterns formed on the printing medium; and calculating an adjustment value required to adjust relative printing positions between the first nozzle array and the second nozzle array in the intersecting direction based on the plurality of first patterns and the second patterns formed on the printing medium.

Further features of the present invention will be apparent from the following description of exemplary embodiments (with reference to the attached drawings).

BRIEF DESCRIPTION OF THE DRAWINGS

The accompanying drawings, which are incorporated in and constitute a part of the specification, illustrate embodiments of the invention, and together with the description, serve to explain the principles of the invention.

FIG. 14 shows an example of the configuration of an order table according to the second embodiment;

DESCRIPTION OF THE EMBODIMENTS

An exemplary embodiment(s) of the present invention will now be described in detail with reference to the drawings. It should be noted that the relative arrangement of the components, the numerical expressions and numerical values set forth in these embodiments do not limit the scope of the present invention unless it is specifically stated otherwise.

Note that the following description will exemplify a printing apparatus which adopts an ink-jet printing system. However, the present invention is not limited to such specific system. For example, an electrophotography system using toners as color materials may be adopted.

The printing apparatus may be, for example, a single-function printer having only a printing function, or a multi-function printer having a plurality of functions including a printing function, FAX function, and scanner function. Also, the printing apparatus may be, for example, a manufacturing apparatus used to manufacture a color filter, electronic device, optical device, micro-structure, and the like using a predetermined printing system.

In this specification, "printing" means not only forming significant information such as characters or graphics but also forming, for example, an image, design, pattern, or structure on a printing medium in a broad sense regardless of whether the formed information is significant, or processing the medium as well. In addition, the formed information need not always be visualized so as to be visually recognized by humans.

Also, a "printing medium" means not only a paper sheet for use in a general printing apparatus but also a member which can fix ink, such as cloth, plastic film, metallic plate, glass, ceramics, resin, lumber, or leather in a broad sense.

Also, "ink" should be interpreted in a broad sense as in the definition of "printing" mentioned above, and means a liquid which can be used to form, for example, an image, design, or pattern, process a printing medium, or perform ink processing upon being supplied onto the printing medium. The ink processing includes, for example, solidification or insolubilization of a coloring material in ink supplied onto a printing medium.

Figure 1:
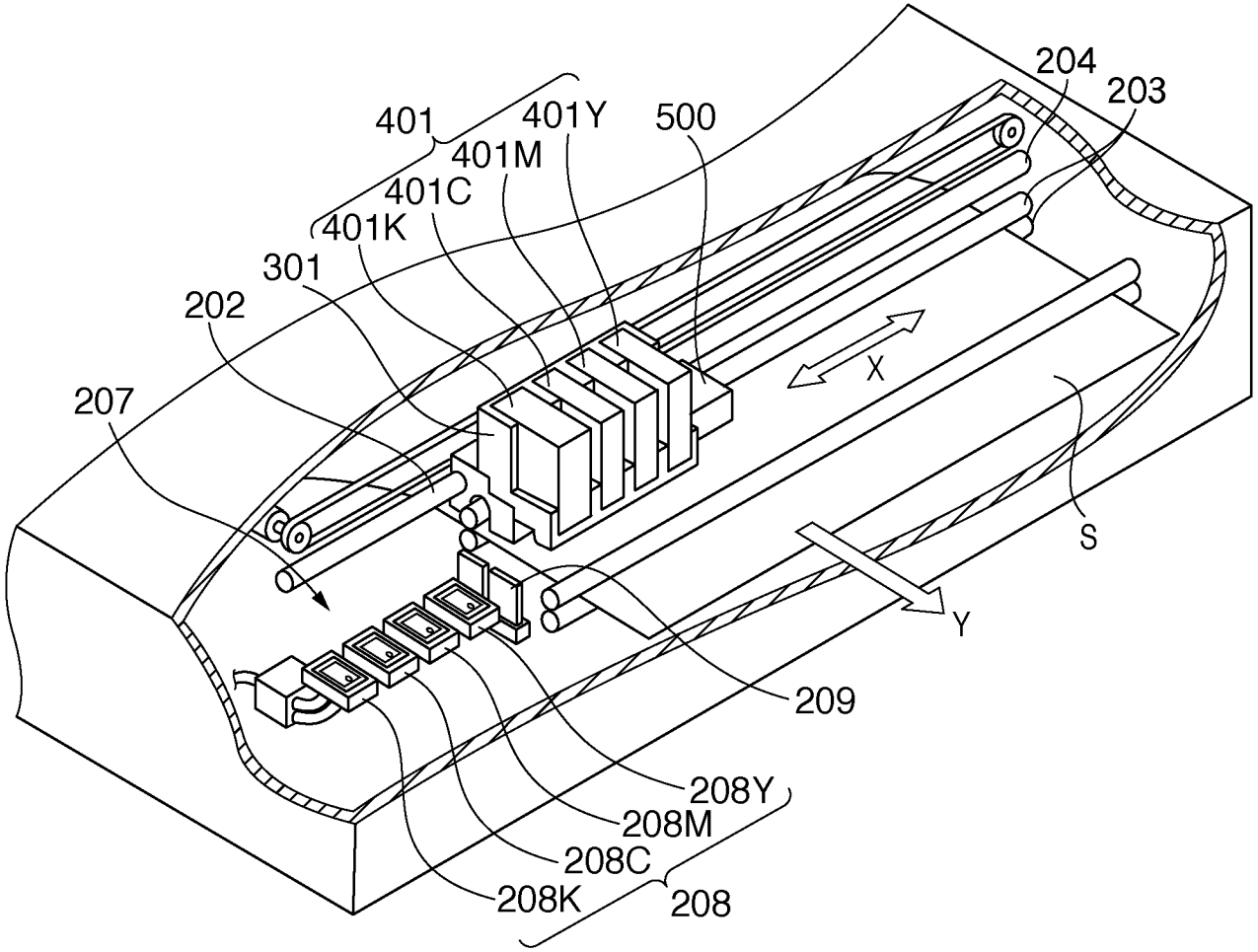
FIG. 1 is a perspective view showing an example of the outer appearance arrangement of a printing apparatus 1 according to an embodiment of the present invention.

FIG. 1 is a perspective view showing an example of the outer appearance arrangement of an ink-jet printing apparatus 1 according to an embodiment of the present invention.

The printing apparatus 1 prints an image by reciprocally moving, in directions of a double-headed arrow X (main scanning direction), a carriage 202 which mounts an ink-jet printhead (to be simply referred to as a printhead hereinafter) 301 that prints by discharging inks according to an ink-jet method. The printing apparatus 1 feeds a printing medium S such as a paper sheet via a paper feed mechanism, and conveys in a direction of an arrow Y (sub scanning direction). Then, the apparatus 1 prints an image by discharging inks onto the printing medium S from the printhead 301 at a predetermined printing position.

The carriage 202 mounts, for example, a (reflection type) optical sensor 500 and ink cartridges 401. In this case, four ink cartridges 401 (cartridges 401K, 401C, 401M, and 401Y), which respectively store black (Bk), cyan (C), magenta (M), and yellow (Y) inks, are mounted. These four ink cartridges 401 are independently detachable.

On the printhead 301, a plurality of nozzle arrays (orifice arrays) required to discharge inks corresponding to respective colors are formed. In this case, nozzle arrays which can discharge black (Bk), cyan (C), magenta (M), and yellow (Y) inks are formed in correspondence with the aforementioned ink cartridges 401.

The printhead 301 has heat generation elements, and discharges inks using heat energy. The heat generation elements are arranged in correspondence with respective orifices, and a pulse voltage is applied to corresponding heat generation elements according to a printing signal. Thus, inks are discharged from the corresponding orifices.

The printhead 301 is detachably mounted on the carriage 202. The carriage 202 is slidably supported by a guide rail 204, and is reciprocally moved along the guide rail 204 by a driving unit (not shown) such as a motor. The printing medium S is conveyed in the sub scanning direction (arrow Y) by convey rollers 203 while maintaining a constant facing gap with an orifice surface (formation surface of ink orifices) of the printhead 301.

Outside a reciprocal moving range of the carriage 202 (outside a printing region), a recovery unit 207 required to recover discharge errors of the printhead 301 is arranged. The position where the recovery unit 207 is arranged is a so-called home position, and the printhead 301 stands still at this position while no printing operation is made. The recovery unit 207 includes caps 208 (caps 208K, 208C, 208M, and 208Y) which can cap the orifices of the printhead 301. The caps 208K, 208C, 208M, and 208Y are configured to respectively cap orifices which discharge black, cyan, magenta, and yellow inks.

A suction pump (negative pressure generator) is connected to the interior of each cap 208. When the caps 208 cap the orifices of the printhead 301, negative pressures are introduced to the interiors of the caps 208 to suction and eject inks from the orifices of the printhead 301 into the caps 208 (suction recovery operation). With this suction recovery operation, the ink discharge performance of the printhead 301 can be maintained.

The recovery unit 207 also includes a wiper 209 such as a rubber blade used to wipe the orifice surface of the printhead 301. The recovery unit 207 executes recovery processing (also called preliminary discharge processing) by discharging inks from the printhead 301 into the caps 208 so as to maintain the ink discharge performance of the printhead 301.

On the carriage 202, a reflection type optical sensor (to be simply referred to as an optical sensor hereinafter) 500 is mounted in addition to the printhead 301 and ink cartridges 401. The optical sensor 500 is a sensor which can acquire optical characteristics. The optical sensor 500 optically reads registration adjustment patterns (to be simply referred to as adjustment patterns hereinafter) printed on the printing medium S, and measures their printing densities.

Figure 2:
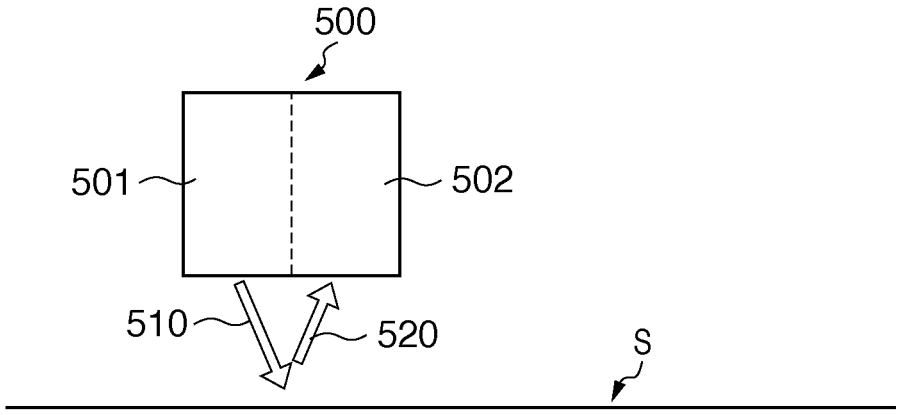
FIG. 2 is a schematic view showing an example of the arrangement of an optical sensor 500 shown in FIG. 1.

The optical sensor 500 includes a light-emitting unit 501 implemented by, for example, an LED, and a light-receiving unit 502 implemented by, for example, a photodiode, as shown in FIG. 2. Irradiation light 510 emitted by the light-emitting unit 501 is reflected by a surface of the printing medium S, and reflected light 520 of the light 510 enters the light-receiving unit 502. The light-receiving unit 502 converts the reflected light 520 into an electrical signal.

Upon measurement of the printing densities of the adjustment patterns, conveyance of the printing medium S in the sub scanning direction and movement of the carriage 202 attached with the optical sensor 500 in the main scanning direction are alternately repeated. Thus, the optical sensor 500 detects the densities of an adjustment pattern group printed on the printing medium as optical reflectances.

Figure 3:
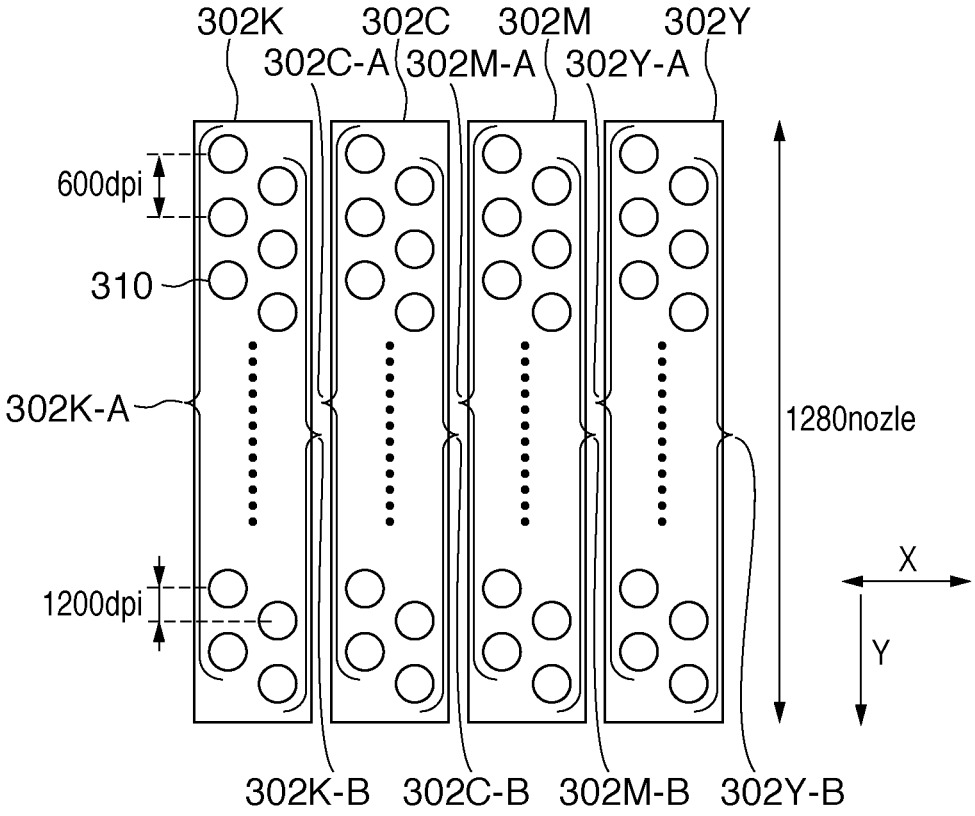
FIG. 3 is a view showing an example of the array configurations of discharge nozzles 310 in a printhead 301 shown in FIG. 1.

An example of the array configuration of the discharge nozzles 310 on the printhead 301 shown in FIG. 1 will be described below with reference to FIG. 3.

On the printhead 301, a plurality of nozzle arrays are arrayed to be shifted from each other in the sub scanning direction (nozzle arrayed direction) which intersects with ("perpendicular to" in this embodiment) the main scanning direction as an arrayed direction of nozzle arrays. More specifically, nozzles 302K, 302C, 302M, and 302Y required to discharge K, C, M, and Y inks are arranged at a predetermined interval in the sub scanning direction (Y direction), and respective nozzle arrays are arrayed in the main scanning direction (X direction). The nozzle arrays are arranged in two arrays each (arrays 302K-A, 302K-B, 302C-A, 302C-B, 302M-A, 302M-B, 302Y-A, and 302Y-B) in correspondence with respective ink colors. In each nozzle array, for example, 1280 nozzles are arranged at an interval of 600 dpi. The nozzle arrays (two nozzle arrays) which discharge an ink of the same color are arranged to be shifted from each other by, for example, 1200 dpi (half a pitch) in the sub scanning direction. That is, in order to attain a high print resolution, the arrayed positions of the nozzle arrays are arranged to be shifted in the sub scanning direction. This method is adopted for the following reason. That is, when an ink droplet size is reduced, a dot size spread on a printing medium is also reduced to increase the resolution, but a dot size reduction is not an easy way to increase the resolution. In this embodiment, the resolution of each nozzle array in the sub scanning direction is 600 dpi, but by shifting the arrayed positions of the nozzle arrays, printing can be done at the resolution of 1200 dpi in the sub scanning direction.

In printing position adjustment processing (to be also referred to as registration adjustment processing hereinafter) according to this embodiment, a plurality of adjustment patterns each including first and second patterns are printed on a printing medium. At this time, relative printing positions of the second patterns with respect to the first patterns in the sub scanning direction are shifted.

Figure 4:
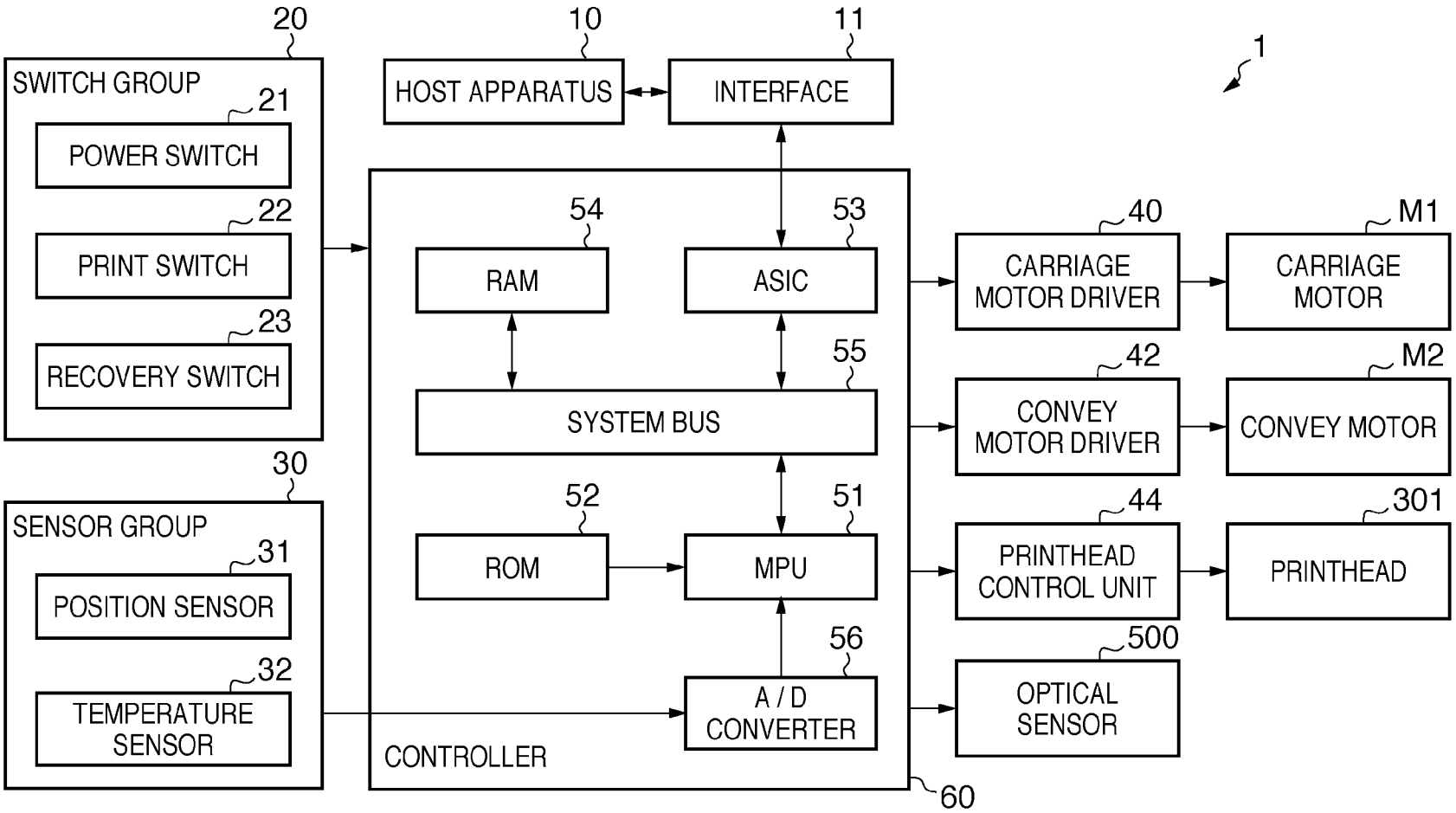
FIG. 4 is a block diagram showing an example of the functional arrangement of the printing apparatus 1 shown in FIG. 1.

An example of the functional arrangement of the printing apparatus 1 shown in FIG. 1 will be described below with reference to FIG. 4.

A controller 60 is configured to include, for example, an MPU 51, ROM 52, ASIC (Application Specific Integrated Circuit) 53, RAM 54, system bus 55, and A/D converter 56. The ROM 52 stores programs corresponding to the control sequence (to be described later), required tables, and other permanent data.

The ASIC 53 controls a carriage motor M1 and convey motor M2. The ASIC 53 also generates a control signal required to control the printhead 301. The RAM 54 is used as, for example, an image data mapping area and a work area for program execution. The system bus 55 inter-connects the MPU 51, ASIC 53, and RAM 54 to exchange data. The A/D converter 56 A/D-converts analog signals input from a sensor group (to be described later), and supplies converted digital signals to the MPU 51.

The MPU 51 systematically controls the operations of the printing apparatus 1. The MPU 51 calculates a registration adjustment value (to be also simply referred to as an adjustment value hereinafter) based on the measurement results of the aforementioned adjustment patterns in, for example, the registration adjustment processing. This adjustment value is stored in, for example, the RAM 54. The MPU 51 adjusts discharge timings of inks to be discharged from respective nozzles based on the adjustment value stored in, for example, the RAM 54, thereby correcting ink landing positions (attached positions) of dots formed on a printing medium.

Reference numeral 20 denotes a switch group, which is configured to include, for example, a power switch 21, print switch 22, and recovery switch 23. Reference numeral 30 denotes a sensor group, which is required to detect apparatus statuses, and is configured to include, for example, a position sensor 31 and temperature sensor 32. The ASIC 53 transfers data required to drive printing elements (discharge heaters) to the printhead 301 while directly accessing a storage area of the RAM 54 upon scanning the printhead 301.

A printhead control unit 44 controls a printing operation by the printhead 301 by scanning the printhead 301 relative to a printing medium.

The carriage motor M1 is a driving source required to reciprocally scan the carriage 202 in predetermined directions. A carriage motor driver 40 controls the driving operation of the carriage motor M1. The convey motor M2 is a driving source required to convey a printing medium. A convey motor driver 42 controls the driving operation of the convey motor M2. The printhead 301 is scanned in a direction (main scanning direction) nearly perpendicular to the convey direction of a printing medium. The optical sensor 500 detects densities of an adjustment pattern group printed on a printing medium as optical reflectances.

A host apparatus 10 is a computer (or a reader or digital camera used to read an image) as a supply source of image data. The host apparatus 10 and printing apparatus 1 exchange, for example, image data, commands, and status signals via an interface (to be abbreviated as an I/F hereinafter) 11. The example of the arrangement of the printing apparatus 1 has been described.

An example of the configuration of adjustment patterns used in the registration adjustment processing will be described below with reference to FIGS. 5A to 5C.

Figure 5A:
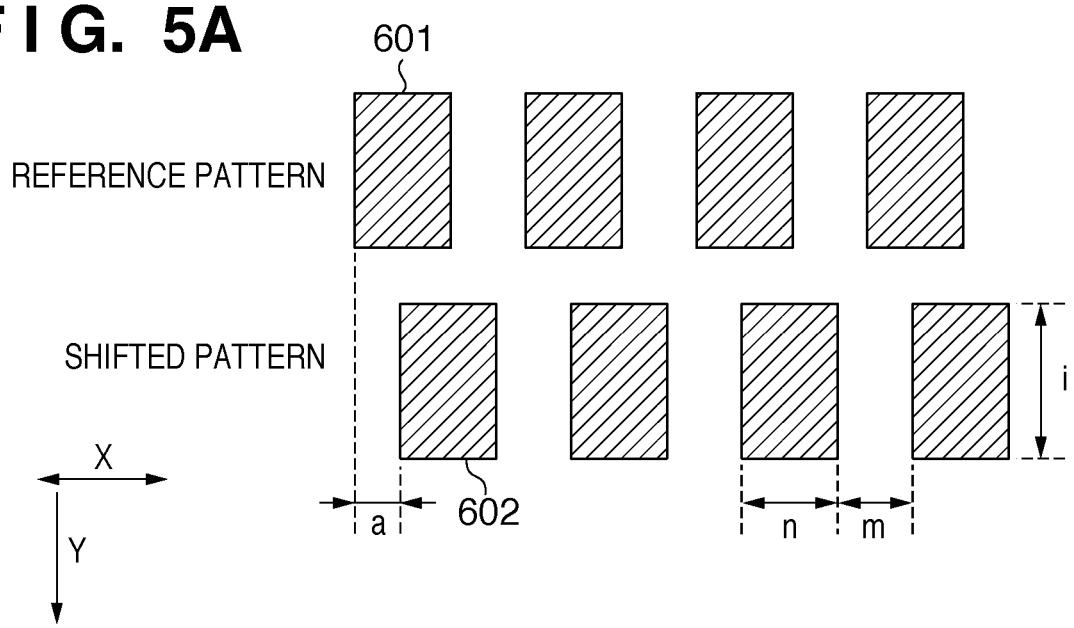
FIGS. 5A to 5C are views showing an example of the configuration of adjustment patterns.

As shown in FIG. 5A, an adjustment pattern is configured by periodically and repetitively forming rectangular patterns each including i pixels×n pixels at intervals of blank regions of m pixels. Also, shifted patterns (second patterns) 602 are printed to have their printing positions shifted by the predetermined number a of pixels in the sub scanning direction with respect to reference patterns (first patterns) 601. The resolution and shifting amount of these adjustment patterns can be decided according to the print resolution of the printing apparatus. Assume that the print resolution is 1200 dpi in this embodiment.

Figure 5B:
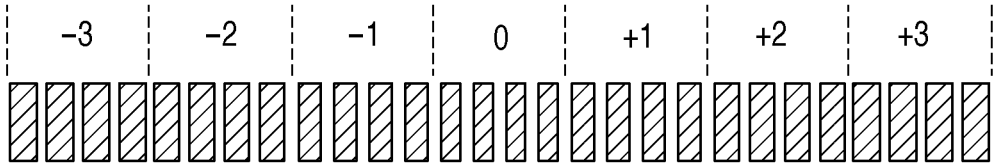
Figure 5C:
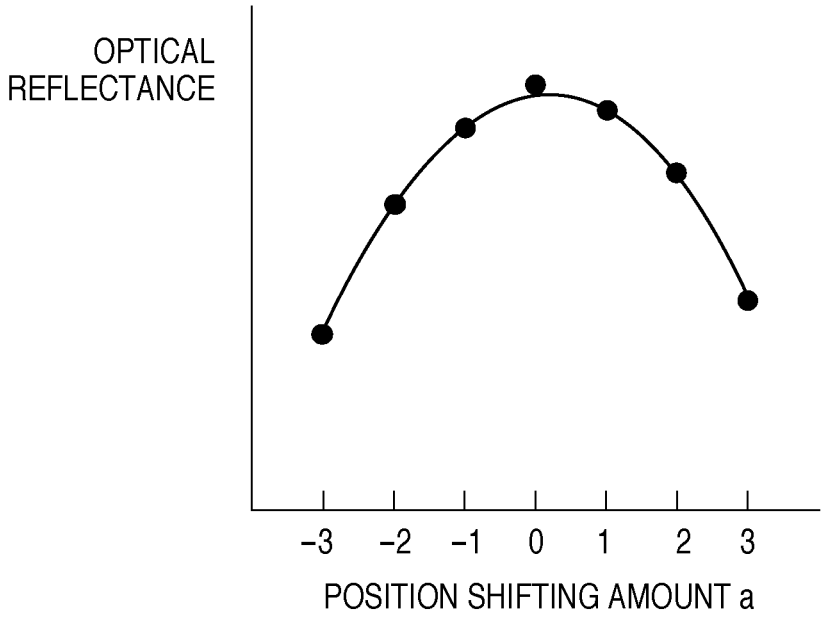

FIG. 5B shows the configuration in which a plurality of adjustment patterns shown in FIG. 5A are juxtaposed. In this case, an adjustment pattern group shown in FIG. 5B is printed while changing the shifting amount a of the shifted patterns (second patterns) in the sub scanning direction within a range from −3 pixels to +3 pixels.

When the shift amount of the printing positions of the shifted patterns with respect to the reference patterns is changed, an area ratio of inks occupied on a printing medium is changed. FIG. 5C shows optical reflectance measurement results of the respective shifted patterns shown in FIG. 5B. Note that a density is inversely proportional to a reflectance, and lowers as a position shift between adjustment patterns actually printed on a printing medium is smaller.

For this reason, in order to match the dot printing positions of the nozzle array used to form the reference patterns with those of the nozzle array used to form the shifted patterns, discharge timings can be adjusted based on the shifting amount when the density of the adjustment pattern is lowest. That is, the discharge timings of inks from the nozzle arrays used to form the shifted patterns can be adjusted.

Note that the number of adjustment patterns to be formed on a printing medium and the shifting amount can be decided according to an adjustment range required from a mechanical tolerance of the apparatus and a shifting unit of the printing positions. That is, the number of patterns to be formed and the shifting amount can be decided in correspondence with the precision of the registration adjustment processing. A printing region of the adjustment patterns can be decided according to, for example, the size of a detection region of the optical sensor 500, the width of a region printable in one print scan, and the size of a printable region of a printing medium with respect to the adjustment pattern group.

The nozzle arrays used to form the reference patterns and shifted patterns are decided based on combinations of ink colors of the nozzle arrays to be adjusted and scanning directions. In adjustment in a forward scan, a reference nozzle array (for example, the array 302K-A) is decided to form the reference patterns, and another nozzle array (for example, the array 302C-A) is used to form the shifted patterns. The same applies to a backward scan.

Note that a landing position of an ink discharged from each nozzle on a printing medium changes due to various causes such as a tilt of the printhead and a discharge speed for each ink. For this reason, strictly speaking, even when printing conditions such as the distance between the printhead and printing medium and the scanning speed of the printhead remain the same, adjustment is required for each nozzle array and for each scanning direction.

Conventionally, the reference patterns and shifted patterns are respectively formed using a single nozzle array. However, since a size reduction of an ink droplet progresses in a recent printing apparatus, when respective patterns are formed using a single nozzle array, a surface of a printing medium cannot be sufficiently filled by dots formed by the single nozzle array.

For this reason, the following problem is posed. In this case, assume that the arrangement interval of nozzles in the sub scanning direction (Y direction) is 600 dpi, as described above. Also, in order to obtain a print resolution of 1200 dpi, a dot size formed on a printing medium ranges from, for example, about 30 to 35 μm, as shown in FIG. 6A.

Figure 6A:
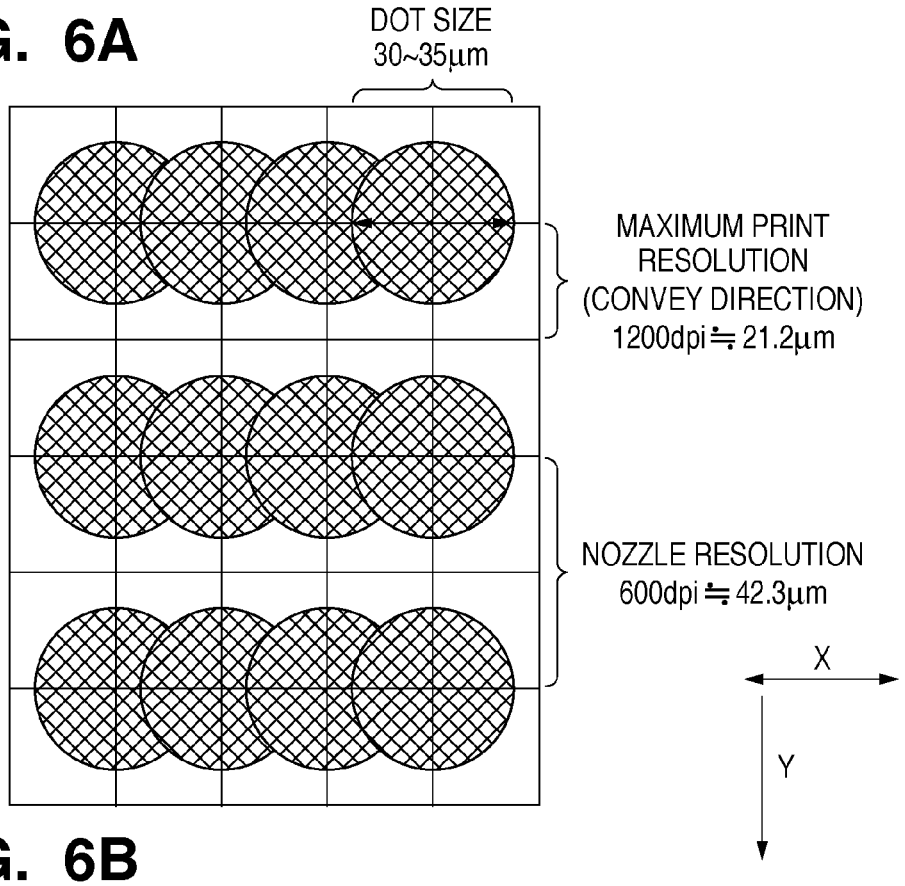
FIGS. 6A and 6B are views showing an example of a conventional problem.
Figure 6B:
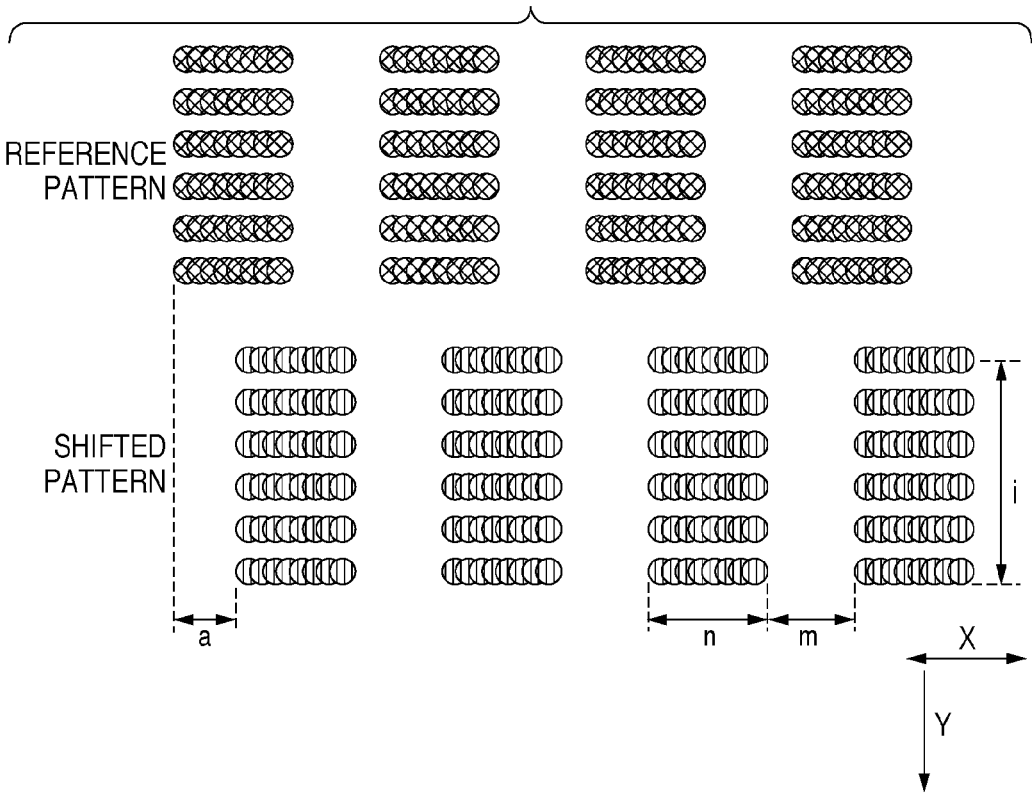

In this case, all dots shown in FIG. 6A are printed using a single nozzle array. When the adjustment patterns are formed using the single nozzle array in this way, dots in each pattern are formed on the printing medium to have gaps in the sub scanning direction (Y direction), as shown in FIG. 6B. With the patterns having such gaps, when some of patterns formed by one of nozzle arrays used to form the reference patterns and shifted patterns suffer shifts of landing positions in the sub scanning direction, unexpected density changes occur.

Figure 7:
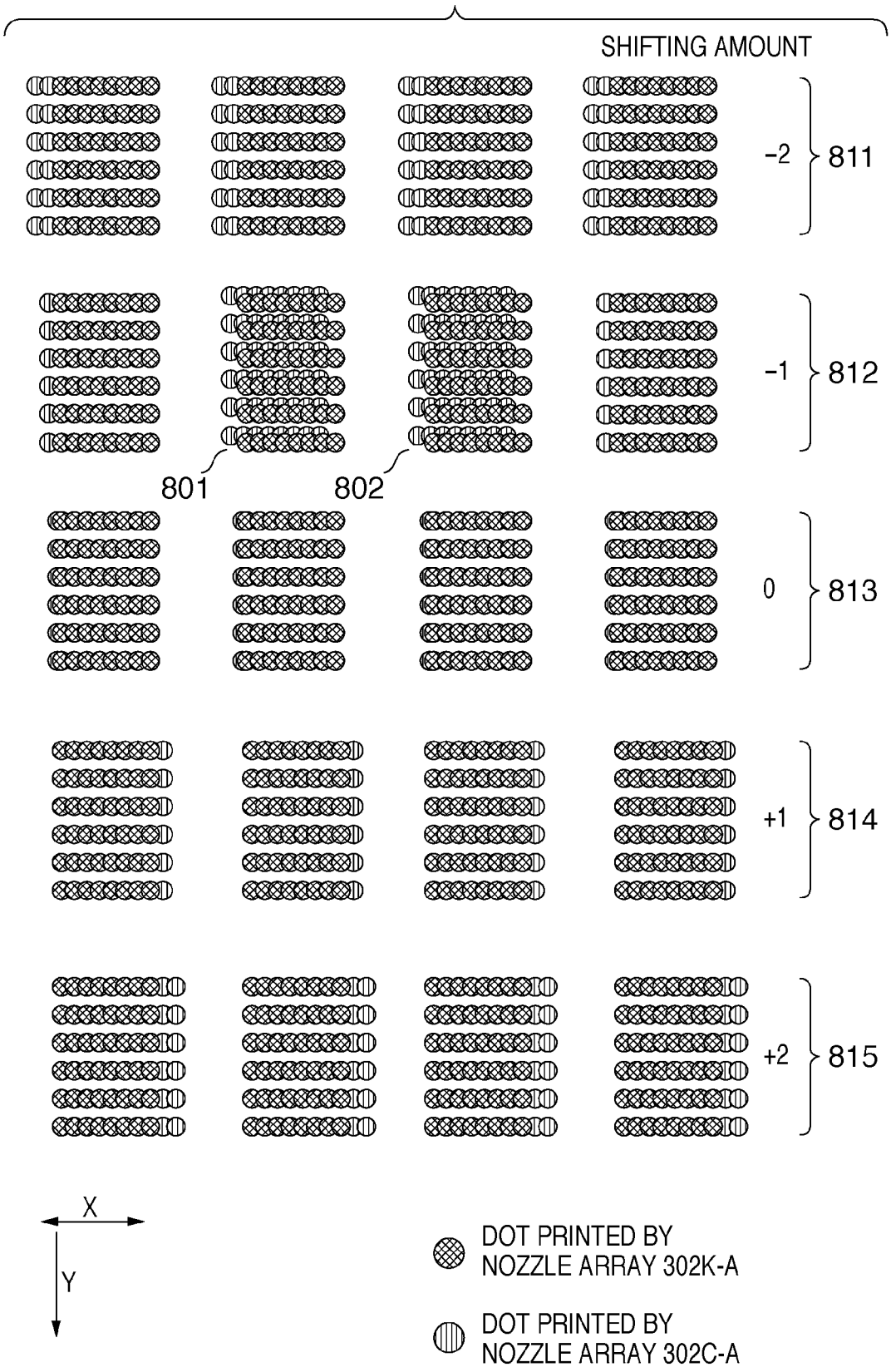
FIG. 7 is a view showing an example of a conventional problem.

FIG. 7 shows an example of adjustment patterns 811 to 815 formed by changing the shifting amount from "−2" to "+2". More specifically, FIG. 7 shows adjustment patterns required to adjust the printing positions of dots formed using the nozzle array 302C-A with respect to those of dots formed using the nozzle array 302K-A in a forward print scan.

In some (patterns 801 and 802) of adjustment patterns 812 having the shifting amount="−1", ink landing positions of dots formed using the nozzle array 302C-A are unwantedly shifted in the sub scanning direction (Y direction) to fill gaps in these patterns. Such shifts of the ink landing positions may be caused by external causes such as vibrations upon movement of the carriage which mounts the printhead and posture variations of the printhead upon scanning due to a distortion of a rail stay which supports the carriage. When the ink landing positions of dots on a printing medium are disarrayed by such disturbances to fill gaps of the adjustment patterns in the sub scanning direction, density changes, which are to be originally obtained, can no longer be obtained.

Figure 8A:
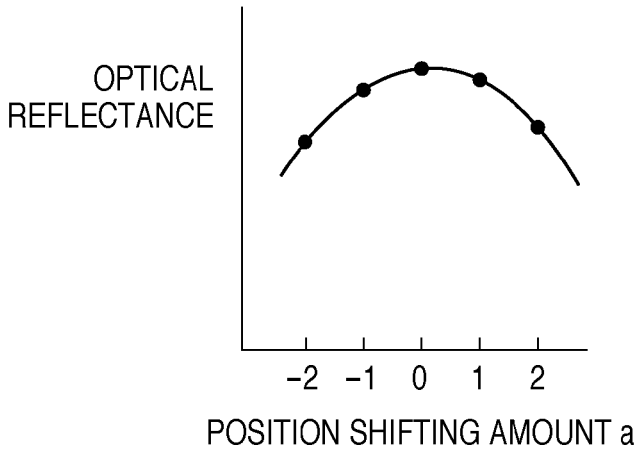
FIGS. 8A to 8C are views showing an example of a conventional problem.
Figure 8B:
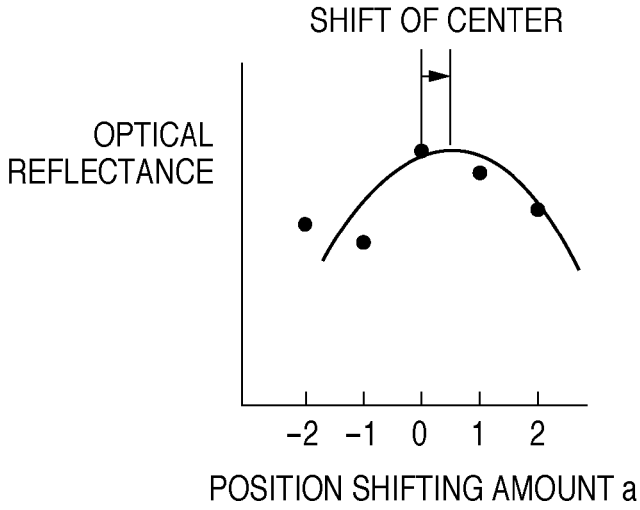
Figure 8C:
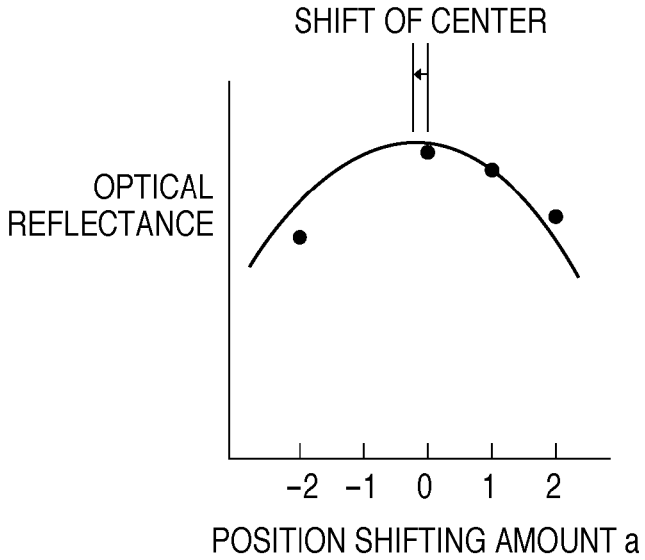

FIGS. 8A to 8C show measurement results (signal values) obtained by reading density changes of the adjustment patterns using the optical sensor 500. FIG. 8A shows the measurement result free from any disarrays of the ink landing positions described using FIG. 7, and FIG. 8B shows the measurement result when the ink landing positions are disarrayed, as described using FIG. 7.

When the ink landing positions are not disarrayed, if the shifting amount is increased/decreased by "1", dots which appear on the printing medium are increased/decreased by one pixel, and a change mainly including that change amount appears in a signal value read by the optical sensor 500. By contrast, when the ink landing positions are shifted, as denoted by reference numerals 801 and 802 in FIG. 7, since gaps between dots in the patterns are filled, signal values are largely decreased, and normal signal changes cannot be obtained.

The aforementioned technique described in Japanese Patent Laid-Open No. 2006-102997 refers to a configuration in which patterns used to detect shifts of the ink landing positions are formed in advance so as to exclude signals of such abnormal patterns. However, with this configuration, since the number of data required to execute the registration adjustment processing is decreased, as shown in FIG. 8C, a precision drop of the registration adjustment processing is unavoidable. Furthermore, since a larger number of patterns have to be printed, the use amounts of inks and printing media are increased.

Also, the aforementioned technique described in Japanese Patent Laid-Open No. 2009-39916 refers to a configuration in which an adjustment value is calculated from a larger number of data when data having a tendency largely different from other data are included. However, with this configuration, the influence of abnormal data is received in no small measure. For this reason, it is difficult to obtain a precise adjustment value for each nozzle array and for each scanning direction. Hence, a configuration required to solve these problems will be described below while giving some examples.

First Embodiment

The first embodiment will be described below. The first embodiment will explain a case in which reference patterns (first patterns) are formed using two nozzle arrays, the nozzle arrayed positions of which are shifted by half a pitch (half a nozzle pitch) in the sub scanning direction.

Figure 9:
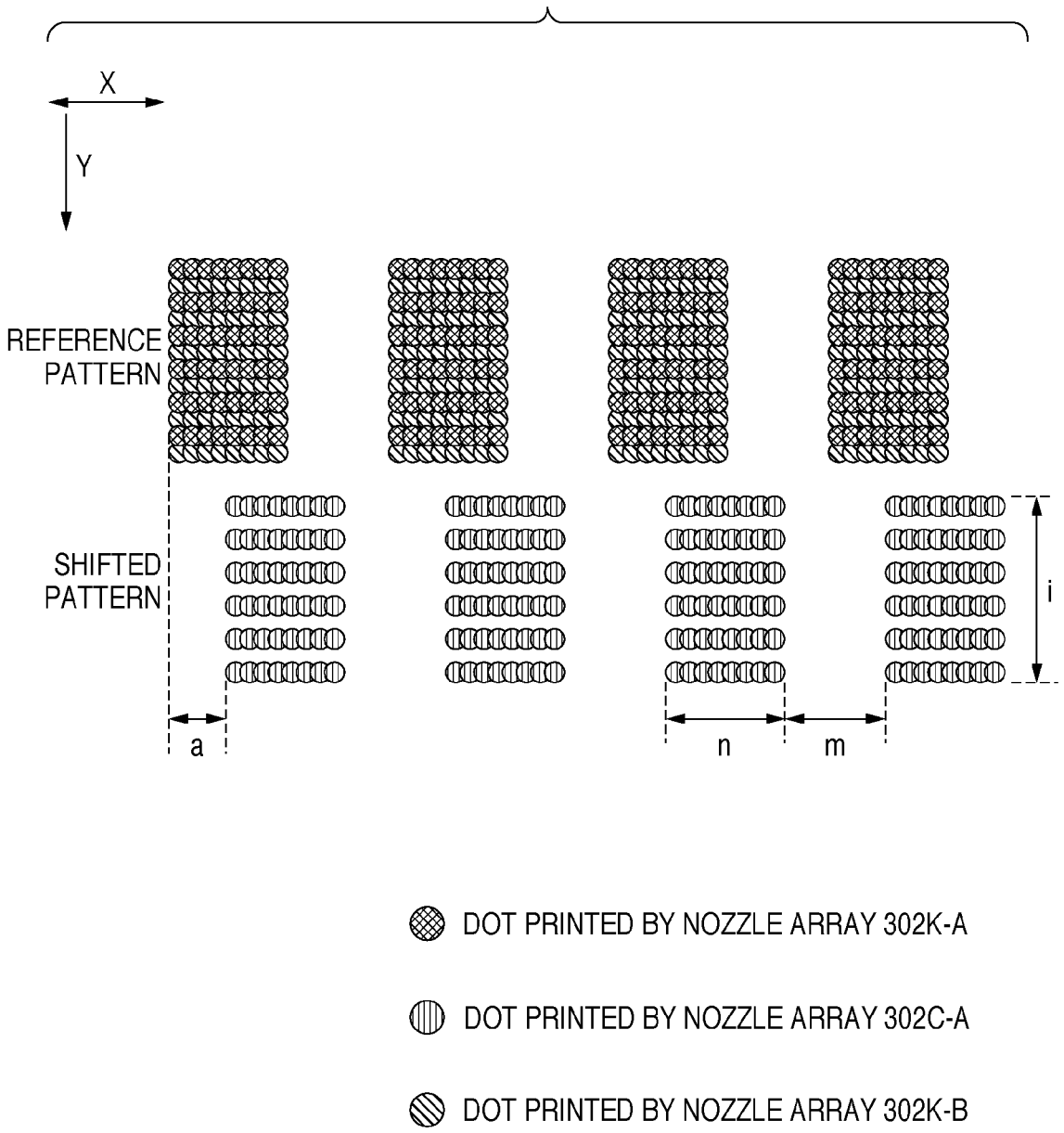
FIG. 9 is a view showing an example of reference patterns and shifted patterns according to the first embodiment.

FIG. 9 shows an example of reference patterns and shifted patterns according to the first embodiment. In this case, the reference patterns are formed using two nozzle arrays (nozzle arrays 302K-A and 302K-B) corresponding to different ink colors.

In order to attain a print resolution of 1200 dpi, a dot size of the adjustment patterns formed on a printing medium becomes small. However, since the reference patterns are formed using the two nozzle arrays, the nozzle arrayed positions of which are shifted in the sub scanning direction, no gaps along the sub scanning direction are formed between dots in the reference patterns.

Figure 10:
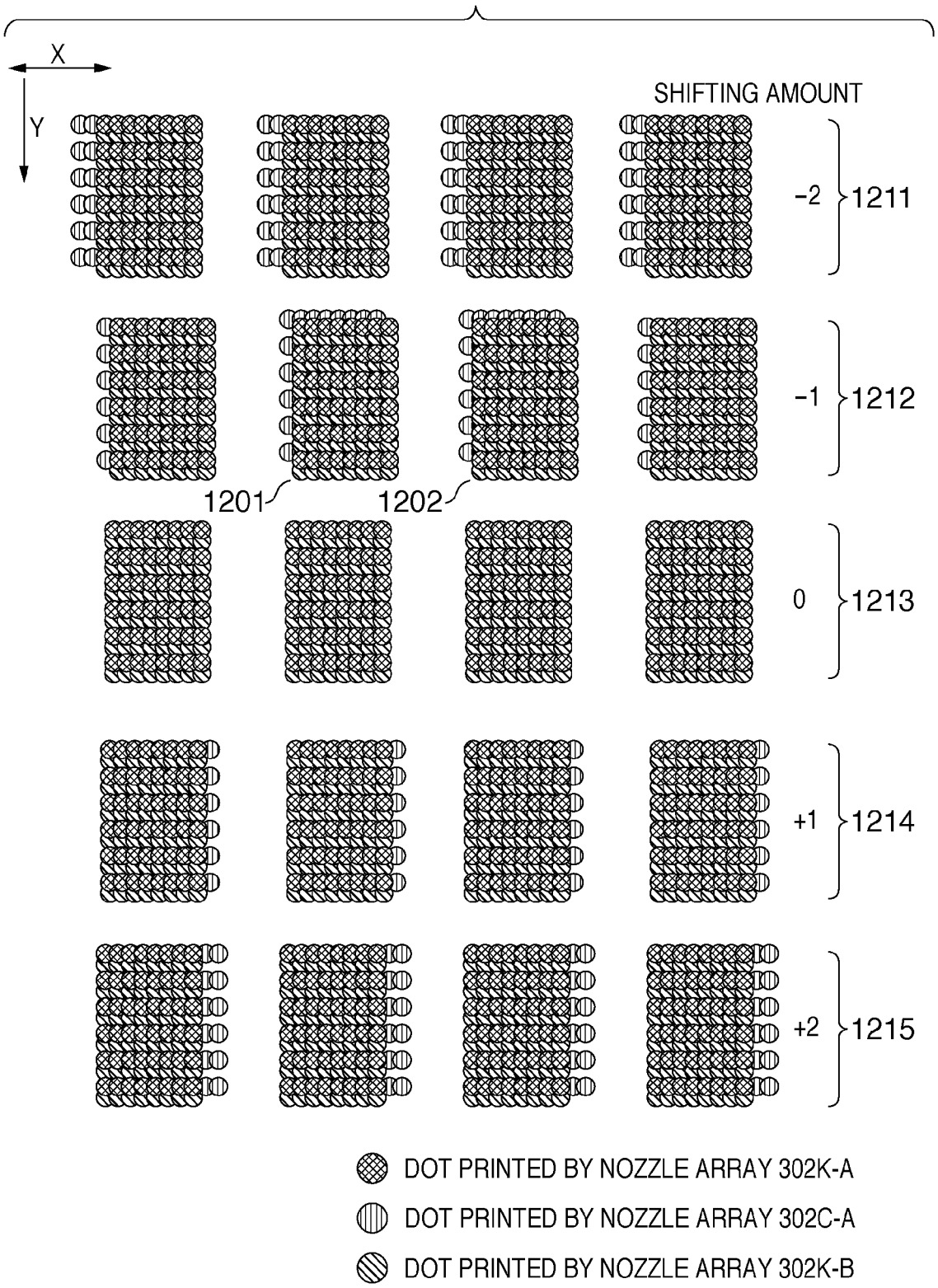
FIG. 10 is a view showing an example of adjustment patterns formed by changing a shifting amount.

FIG. 10 shows an example of the adjustment patterns formed by changing the shifting amount as in FIG. 7.

In some (patterns 1201 and 1202) of adjustment patterns 1212 in FIG. 10, printing positions of dots formed using the nozzle array 302C-A are shifted in the sub scanning direction as in the adjustment patterns 812 shown in FIG. 7. Such shifts are caused by, for example, the aforementioned disturbances.

However, in this case, since there are no gaps between dots in the adjustment patterns, unexpected density changes do not take place. For this reason, even when the dot printing positions are disarrayed due to, for example, the disturbances, normal density changes can be obtained, as shown in FIG. 8A. Thus, since a precise adjustment value can be acquired, it leads to improvement of the print quality.

The acquired adjustment value can be held as that used to adjust printing positions of dots formed using the nozzle array 302C-A to be adjusted with respect to those of dots formed by one of the nozzle arrays 302K-A and 302K-B used to form the reference patterns.

Note that the same adjustment applies to the bidirectional printing operations (that is, dot printing positions in the forward and backward print scans). For example, upon forming the reference patterns, printing is done using the nozzle arrays 302K-A and 302K-B in a forward direction. Also, upon forming the shifted patterns, printing is done using the nozzle array 302K-A in a backward direction. In this manner, the dot printing positions by the bidirectional printing operations of the same nozzle array 302K-A can be precisely adjusted.

An example of the functional arrangement of a control system implemented in the controller 60 shown in FIG. 4 will be described below with reference to FIG. 11. In this case, the functional arrangement associated with registration adjustment processing according to the first embodiment will be exemplified.

The controller 60 includes, as its functional arrangement, a reference nozzle array selection unit 71, adjustment nozzle array selection unit 72, first print control unit 73, second print control unit 74, adjustment value calculation unit 75, print control unit 76, and adjustment processing control unit 77.

The reference nozzle array selection unit 71 selects a plurality of nozzle arrays used to form reference patterns. For example, when the printhead 301 is configured by arranging a plurality of chips, a plurality of nozzle arrays arrayed in a single chip are selected as reference nozzle arrays.

The adjustment nozzle array selection unit 72 selects a nozzle array as a registration adjustment target. That is, the selection unit 72 selects a nozzle array used to form shifted patterns.

The first print control unit 73 controls processing for forming a plurality of reference patterns (first patterns) on a printing medium. The second print control unit 74 controls processing for forming shifted patterns (second patterns) to be overlaid on the first patterns while changing a shift amount in the main scanning direction with respect to the plurality of reference patterns formed on the printing medium.

The adjustment value calculation unit 75 calculates an adjustment value required to adjust printing positions of dots by the adjustment nozzle array. More specifically, the calculation unit 75 calculates an adjustment value required to adjust printing positions of dots by the adjustment nozzle array with respect to those of dots by one of the nozzle arrays used to form the first patterns based on density changes of the first and second patterns formed on the printing medium. The adjustment processing control unit 77 systematically controls processing associated with the registration adjustment processing.

The print control unit 76 controls a printing operation by adjusting discharge timings of inks discharged from respective nozzles based on the adjustment value stored in, for example, the RAM 54. Thus, ink landing positions (attached positions) of dots formed on the printing medium are corrected.

An example of the processing sequence in the printing apparatus 1 according to the first embodiment will be described below with reference to FIG. 12. In this case, the processing sequence upon calculation of a registration adjustment value based on the adjustment patterns shown in FIG. 10 will be explained.

The printing apparatus 1 controls the reference nozzle array selection unit 71 to select nozzle arrays used as references (reference nozzle arrays), and controls the adjustment nozzle array selection unit 72 to select a nozzle array to be adjusted (adjustment nozzle array: a third nozzle array) (S101). Note that two nozzle arrays arrayed to be shifted by half a pitch in the sub scanning direction (first and second nozzle arrays) are selected as the reference nozzle arrays.

The printing apparatus 1 forms reference patterns on a printing medium using the reference nozzle arrays under the control of the first print control unit 73 (S102), and forms shifted patterns on the printing medium using the adjustment nozzle array under the control of the second print control unit 74 (S103). Note that when bidirectional registration adjustment is to be attained, for example, a nozzle array to be adjusted and a nozzle array which is shifted from that nozzle array by half a pitch in the sub scanning direction are selected, and reference patterns are printed using these two nozzle arrays in a forward or backward print scan. In a print scan in the remaining direction, shifted patterns are printed using the nozzle array to be adjusted.

After that, the printing apparatus 1 reads densities of the adjustment patterns formed on the printing medium using the optical sensor 500 (S104). Since the densities of the adjustment patterns are obtained as optical reflectances by the optical sensor 500, as shown in FIG. 8A, the printing apparatus 1 controls the adjustment value calculation unit 75 to calculate an approximate curve based on the changes of the optical reflectances. The adjustment value calculation unit 75 specifies a shifting amount a which minimizes position shifts between the reference and shifted patterns based on the approximate curve. Then, the adjustment value calculation unit 75 calculates a registration adjustment value based on the shifting amount a (S105). Note that when the resolution of the adjustment patterns is 4800 dpi, the registration adjustment value is calculated by a unit of 4800 dpi.

The printing apparatus 1 repetitively executes the processes in steps S101 to S105 until registration adjustment values corresponding to respective nozzle arrays are calculated (NO in step S106). Upon completion of calculations of the registration adjustment values from all the nozzle arrays (YES in step S106), the printing apparatus 1 stores the calculated registration adjustment values in a storage area of, for example, the RAM 54 (S107). Then, the printing apparatus 1 ends this processing.

As described above, according to the first embodiment, reference patterns are formed using two nozzle arrays, which are arrayed to be shifted in the sub scanning direction. For this reason, no gaps are formed between dots in the reference patterns. Hence, density variations caused by disturbances can be suppressed, and precise registration adjustment processing can be attained.

Second Embodiment

The second embodiment will be described below. In this case, when reference patterns are formed using a plurality of nozzle arrays, printing positions of dots formed respectively by the plurality of nozzle arrays on a printing medium are often largely shifted in the main scanning direction of the printhead.

Figure 13A:
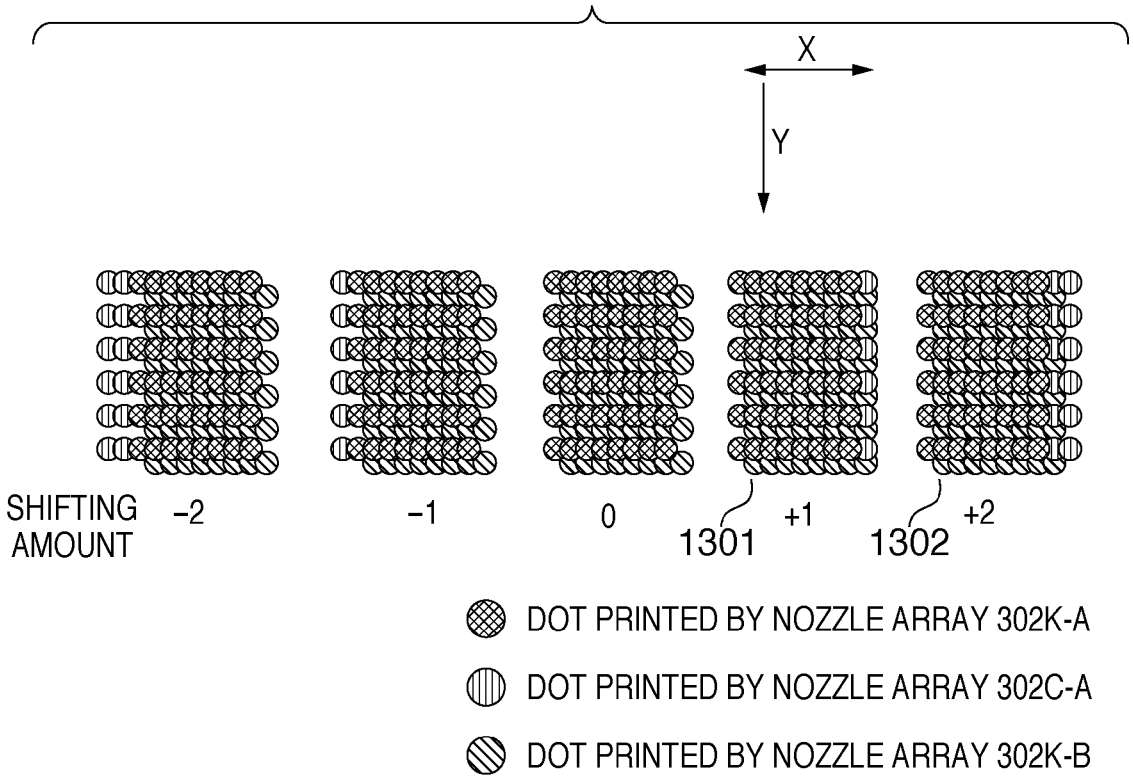
FIGS. 13A and 13B are views for explaining a problem to be solved by the arrangement of the second embodiment.
Figure 13B:
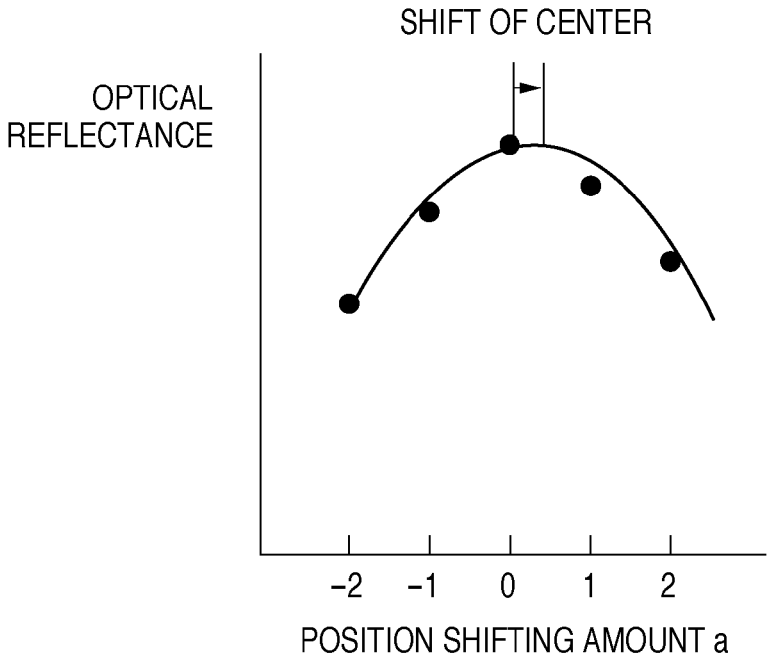

This problem will be described below with reference to FIGS. 13A and 13B. FIG. 13A shows an example of the configuration of adjustment patterns when a shift of an ink landing position for one pixel has occurred in the main scanning direction (X direction) between nozzle arrays (nozzle arrays 302K-A and 302K-B) used to form reference patterns. FIG. 13B shows the measurement result (signal values) obtained by reading density changes of the adjustment patterns shown in FIG. 13A. In this case, a case will be exemplified below wherein printing positions between nozzle arrays corresponding to different ink colors (the nozzle arrays 302K-A and 302K-B and the nozzle array 302C-A) are to be adjusted.

In the adjustment patterns shown in FIG. 13A, when a shifting amount="0", printing positions of dots formed by reference and adjustment nozzle arrays in the main scanning direction normally match. However, in this case, printing positions do not match between the plurality of nozzle arrays used to form the reference patterns, that is, the printing positions of dots formed using the nozzle array 302K-B protrude by one pixel in the main scanning direction with respect to those of dots formed using the nozzle array 302K-A. For this reason, even when shifted patterns are formed to be shifted step by step using the nozzle array 302C-A to be adjusted with respect to the reference patterns, the signal values do not symmetrically change with reference to a peak, as shown in FIG. 13B.

This problem is caused by some of shifted patterns formed using the nozzle array 302C-A which are filled by the reference patterns formed using the nozzle array 302K-B (patterns 1301 and 1302). In this state, signal values corresponding to the shifting amount cannot be normally obtained, and a correct adjustment value cannot be obtained.

Hence, in the second embodiment, the printing positions of dots formed by the respective nozzle arrays 302K-A and 302K-B used to form the reference patterns are adjusted in advance. In this adjustment between the nozzle arrays, even when ink landing positions are disarrayed in the sub scanning direction in some patterns, the adjustment precision does not seriously deteriorate. This is because since patterns printed by the nozzle array 302K-A and those printed by the nozzle array 302K-B are shifted by 1200 dpi in the sub scanning direction, no gaps are formed in the sub scanning direction when the patterns are formed to overlap each other. Even when the ink landing positions are disarrayed slightly in the sub scanning direction, nearly no density change occurs. For this reason, adjustment can be precisely executed between these two nozzle arrays without any special devise.

In consideration of this, in the second embodiment, an order table which specifies an order of adjustment of a nozzle array to be adjusted, and nozzle arrays used to form the reference patterns upon adjustment of that nozzle array is held in advance in, for example, the ROM 52. For example, since there are two different printing directions, that is, forward and backward directions, and there are eight different nozzle arrays, that is, 4 colors×2 arrays, there are a total of 16 different printing operations. Hence, the order table specifies 15 adjustment items and their order in association with each other, as shown in FIG. 14.

As described above, in the second embodiment, adjustment between a plurality of nozzle arrays (=between A and B arrays) used to form the reference patterns is executed according to a predetermined order before the aforementioned registration adjustment processing, thereby solving the aforementioned problem.

Figure 15:
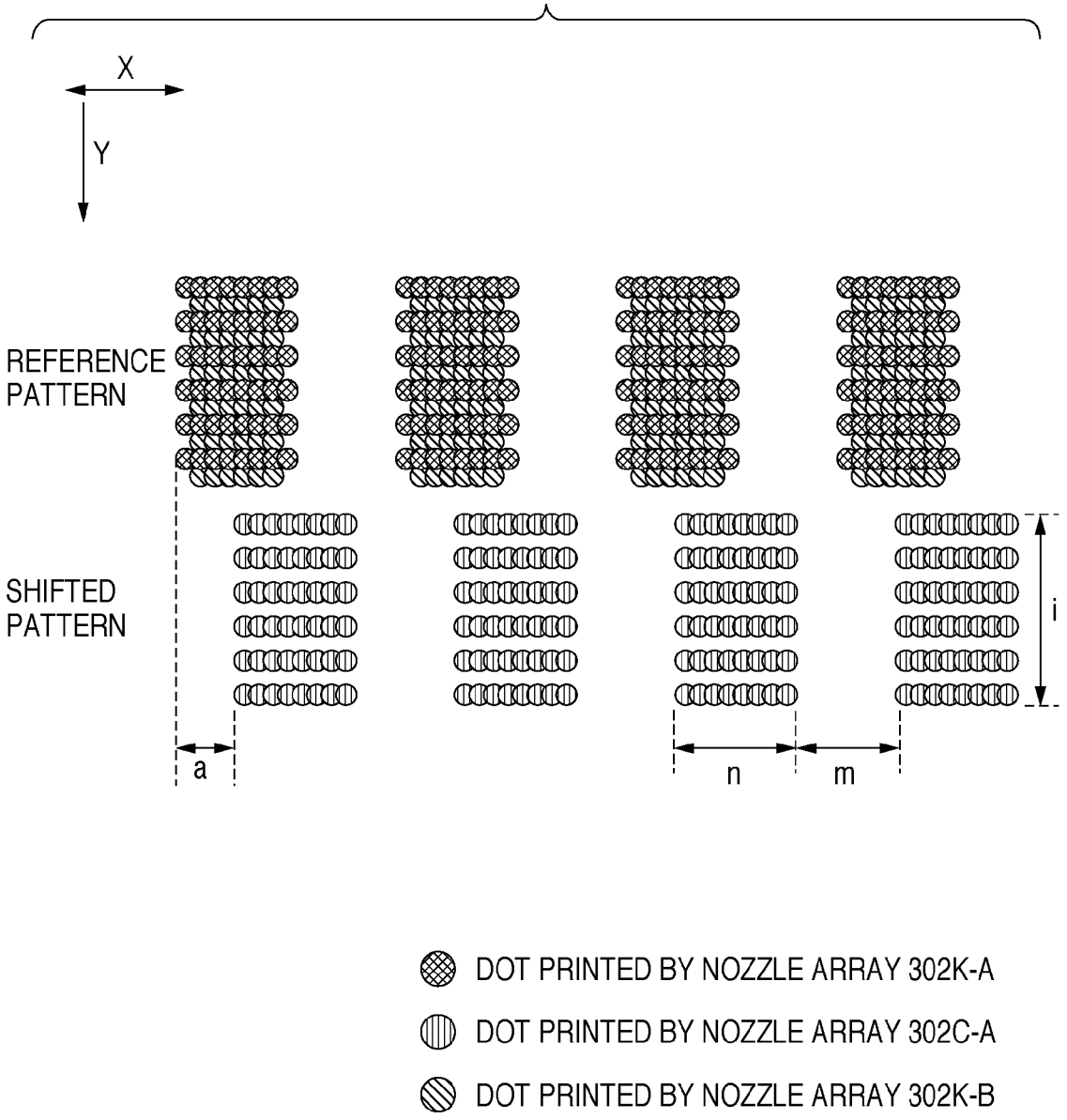
FIG. 15 is a view showing an example of the configuration of a modification of reference patterns according to the second embodiment.

In consideration of the fact that adjustment between A and B arrays used to form the reference patterns is not always perfect, reference patterns may be formed by a configuration shown in FIG. 15. In reference patterns shown in FIG. 15, patterns formed by the nozzle array 302K-B are arranged inside those formed by the nozzle array 302K-A to have a width shorter by one pixel at the two ends than the patterns formed by the nozzle array 302K-A. Note that when reference patterns are formed using three or more nozzle arrays, the width of patterns in the main scanning direction formed by other nozzle arrays can be set to be shorter than that of patterns formed by one of these nozzle arrays.

Using such patterns, even if adjustment between A and B arrays suffers variations, patterns formed by the B array do not protrude from those formed by the A array by ±1 pixel, and do not influence the precision of the registration adjustment processing. Of course, when the length in the main scanning direction of each pattern formed by the B array is shortened, an effect of preventing deterioration of the precision of the registration adjustment processing caused by shifts of ink landing positions in the sub scanning direction of the nozzle array used to form the shifted pattern also deteriorates. For this reason, the number of pixels by which each pattern formed by the B array is shortened is desirably decided by appropriately evaluating the adjustment precision between the A and B arrays and precision deterioration caused by shifts of ink landing positions.

An adjustment value acquired in this way can be calculated using the printing positions of dots formed by the nozzle array 302K-A in place of the nozzle array 302K-B which forms the adjustment patterns having a shorter width. That is, an adjustment value can be calculated based on the printing positions of dots formed by the nozzle array 302C-A with respect to those of dots formed by the nozzle array 302K-A.

Figure 11:
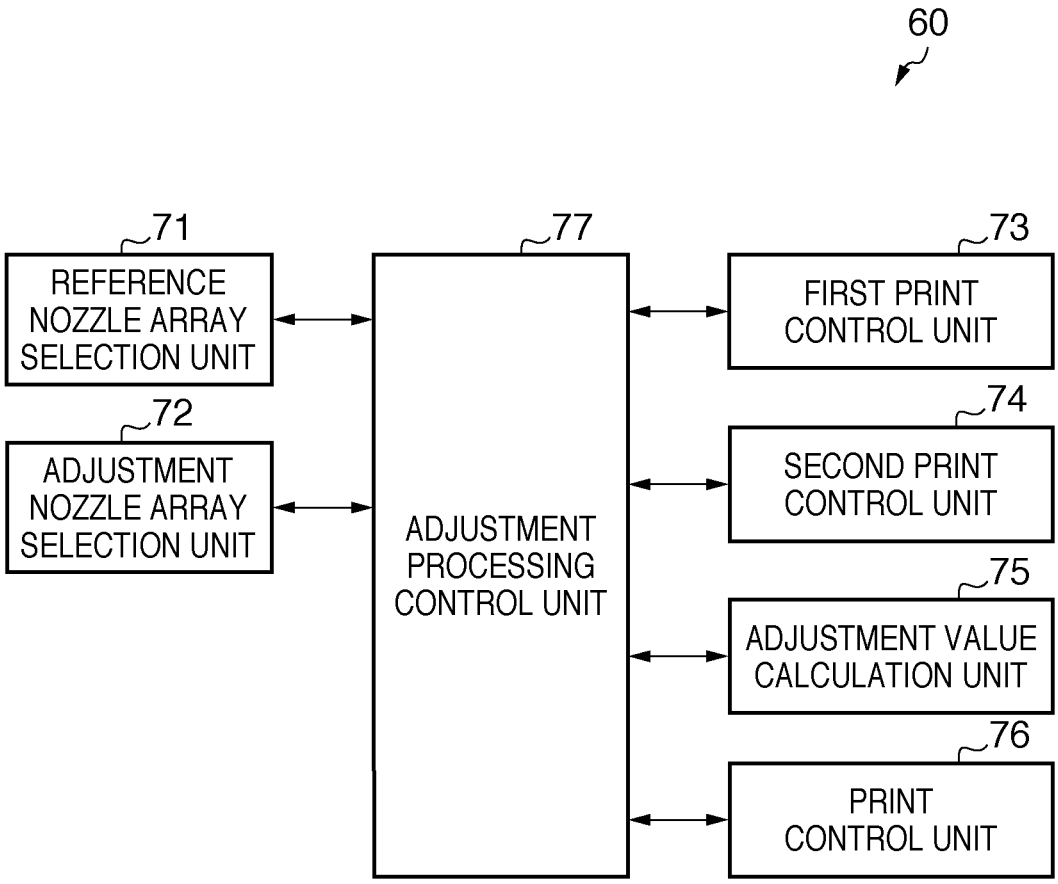
FIG. 11 is a block diagram showing an example of the functional arrangement of a control system implemented in a controller 60 shown in FIG. 4.
Figure 12:
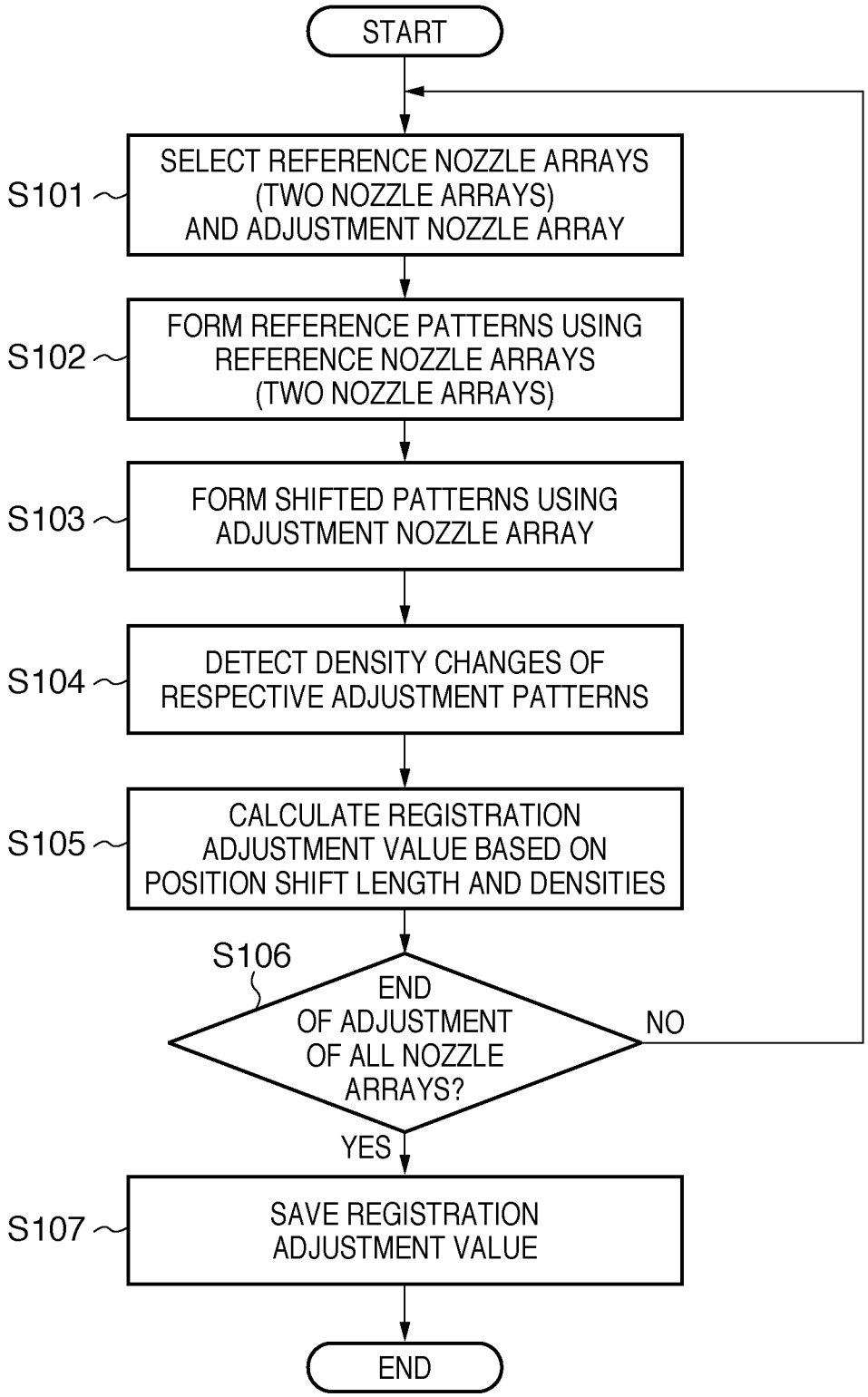
FIG. 12 is a flowchart showing an example of the processing sequence of the printing apparatus 1 according to the first embodiment.

Note that the functional arrangement in the controller 60 and the sequence of the registration adjustment processing according to the second embodiment are the same as those in FIGS. 11 and 12 used to explain the first embodiment, and a description thereof will not be repeated. In the registration adjustment processing according to the second embodiment, after the reference nozzle arrays are selected in the process of step S101, adjustment is executed between these reference nozzle arrays unlike in the processing of the first embodiment.

As described above, according to the second embodiment, after dot printing positions between a plurality of nozzle arrays used to form the reference patterns are adjusted, the same registration adjustment processing as in the first embodiment is executed. In this way, since dot printing positions are not disarrayed in the main scanning direction upon formation of the reference patterns, unexpected density changes can be suppressed.

Third Embodiment

The third embodiment will be described below. The aforementioned first and second embodiments have explained the case in which since gaps along the sub scanning direction are formed between dots in adjustment patterns, the gaps are filled using a plurality of nozzle arrays, the arrayed positions of which are shifted. By contrast, the third embodiment will explain a configuration in which gaps along the sub scanning direction, which are formed between dots in the adjustment patterns, are filled using a single nozzle array.

In the adjustment patterns 812 shown in FIG. 7, gaps in the convey direction of the adjustment patterns, which are formed upon printing using a single nozzle array, are formed when a dot is formed by one ink droplet at each printing position (pixel) on a printing medium. Extremely speaking, when dots are printed at one printing position to overlap each other by a plurality of ink droplets, since inks overflow at that position, such gap is not formed.

That is, it is not desired to land overflowing ink droplets since deterioration of the precision of the registration adjustment processing is apprehensive. However, when a plurality of dots are formed at a single position so as not to impair the adjustment precision due to disarrays of ink landing positions caused by disturbances, it is an effective method for improvement of the precision of the registration adjustment processing.

Figure 16:
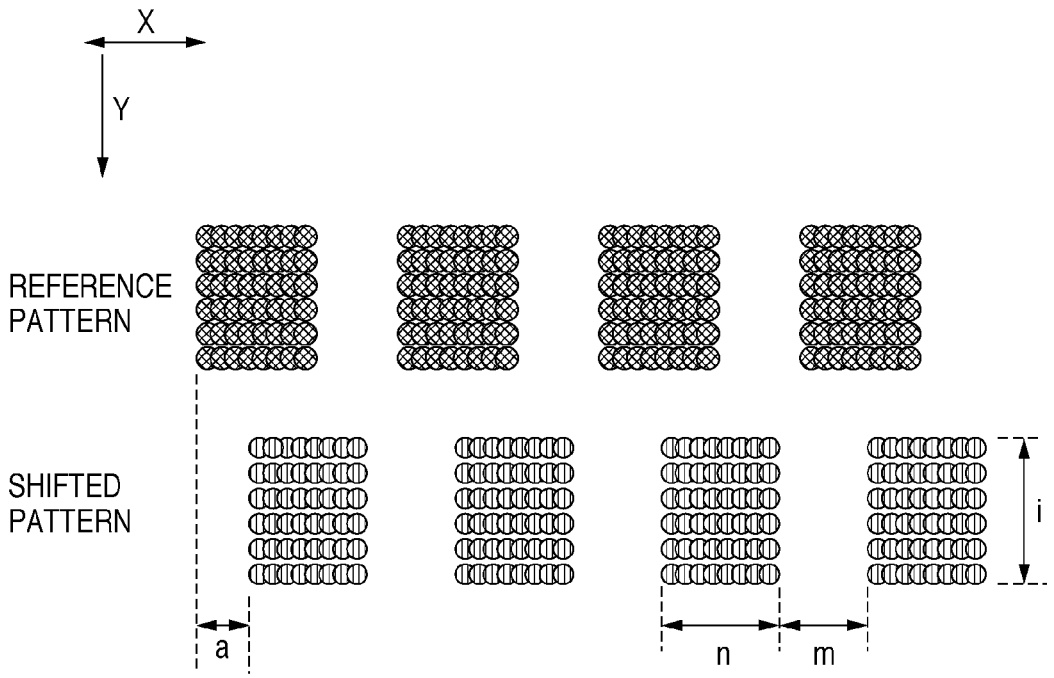
FIG. 16 is a view showing an example of the configuration of reference patterns according to the third embodiment.

Hence, in the third embodiment, a dot is formed at each printing position (pixel) on a printing medium using two ink droplets when reference patterns are printed. As a result, as shown in FIG. 16, gaps along the sub scanning direction in the reference patterns are filled, and even when ink landing positions are shifted due to disturbances, large density changes are not caused by these shifts, and adjustment can be done with high precision.

Of course, since the way inks bleed upon landing a plurality of ink droplets at a single printing position varies depending on ink compositions and media types, the number of ink droplets, which can suppress density changes caused by shifts of the ink landing positions can be appropriately selected. The same method can be used in adjustment of printing positions in bidirectional printing (those in forward and backward print scans).

Note that the functional arrangement in the controller 60 and the sequence of the registration adjustment processing according to the third embodiment are the same as those in FIGS. 11 and 12 used to explain the first embodiment, and a description thereof will not be repeated. In the registration adjustment processing according to the third embodiment, only one reference nozzle array is selected in the process in step S101 unlike in the processing of the first embodiment.

As described above, according to the third embodiment, only one nozzle array used to form reference patterns is selected, and prints a plurality of dots at a single pixel position, thereby forming reference patterns on a printing medium. This configuration is particularly effective for a case in which printing positions between nozzle arrays corresponding to the same color are to be adjusted.

Note that the configuration of the third embodiment is expressed more generally as the following technique. In a printing apparatus which uses a printhead including first and second nozzle arrays, the first nozzle array discharges a plurality of ink droplets for a single position on a printing medium to print first patterns. The second nozzle array discharges inks to print second patterns while changing a shifting amount with respect to the first patterns, and an adjustment value is calculated based on the first and second patterns.

Note that in this case, the first nozzle array corresponds to the reference nozzle array according to the third embodiment, and the second nozzle array corresponds to the adjustment nozzle array according to the third embodiment. In the third embodiment, the first nozzle array (reference nozzle array) and the adjustment nozzle array (second nozzle array) need not be shifted by half a pitch in the sub scanning direction.

The representative embodiments of the present invention have been exemplified. However, the present invention is not limited to the aforementioned and illustrated embodiments, and appropriate modifications of the present invention can be practiced within the spirit of the invention.

For example, disarrays of ink landing positions by a nozzle array used to form shifted patterns (=a nozzle array to be adjusted) have been explained. Even when nozzle arrays used to form reference patterns suffer such disarrays of the ink landing positions, deterioration of the precision can be preferably avoided by the embodiments of the present invention.

The aforementioned first and second embodiments have exemplified the case in which two nozzle arrays, the arrayed positions of which are shifted by half a pitch (1200 dpi) are used as nozzle arrays used to form reference patterns. However, the present invention is not limited to this. That is, gaps in adjustment patterns need only be filled, and the nozzle arrays which are shifted by the half pitch need not always be selected. Alternatively, the reference patterns may be formed using three or more nozzle arrays.

The aforementioned first and second embodiments have exemplified the case in which a plurality of nozzle arrays are used to form reference patterns. However, the present invention is not limited to this. For example, a plurality of nozzle arrays may be used to form shifted patterns, or both reference and shifted patterns may be formed using a plurality of nozzle arrays.

The aforementioned first and second embodiments have exemplified the case in which a plurality of nozzle arrays are used to form reference patterns in both adjustment of bidirectional printing and that between nozzle arrays corresponding to different colors. However, the present invention is not limited to this. For example, reference patterns may be formed using a plurality of nozzle arrays in only registration adjustment processing for bidirectional printing for specific colors or that between nozzle arrays of specific colors.

If the adjustment value calculated in the aforementioned first to third embodiments need not be updated, a default value of the adjustment value may be decided in, for example, an inspection process at the time of factory delivery, and may be stored in, for example, the ROM 52. However, when registration adjustment processing is executed according to an instruction of the user or service person, or when a printing apparatus is carried into a service center, for example, the adjustment value may be stored in an EEPROM (not shown), thus allowing to update the adjustment value as needed.

The configurations and numbers of nozzle arrays and the printhead, and types and the number of ink colors described in the first to third embodiments are merely examples, and can be changed as needed. For example, in the above description, the printing apparatus which mounts four color inks Bk, C, M, and Y have been exemplified. Alternatively, a printing apparatus may additionally mount spot color inks such as light cyan and light magenta having a low density, or red and green. Alternatively, a printing apparatus may mount a plurality of printheads.

The aforementioned first to third embodiments have exemplified the ink-jet printing apparatus. However, the present invention is not limited to this. The present invention is applicable to printing apparatuses of other printing methods. That is, the printing method is not particularly limited as long as printing is executed by forming dots while relatively moving a printhead and printing medium (relative movement).

The aforementioned first to third embodiments have exemplified density detection using the optical sensor as the method of detecting shifts of adjustment patterns. However, the present invention is not limited to this. For example, the user may visually select an optimal pattern, and may input the selected pattern to the printing apparatus, thereby acquiring an adjustment value.

As described above, according to the present invention, even when formation of adjustment patterns is influenced by disturbances, large density changes of the adjustment patterns caused by the disturbances can be suppressed. Then, an adjustment value can be calculated more precisely than a case without the arrangement of the present invention. Hence, registration processing can be executed precisely.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-150265 filed on Jun. 30, 2010, which is hereby incorporated by reference herein in its entirety.

What is claimed is:

1. A printing apparatus which prints by discharging inks from respective nozzle arrays while relatively moving a printhead with respect to a printing medium in an intersecting direction which intersects with a nozzle-arrayed direction, the printhead comprising a plurality of nozzle arrays including at least a first nozzle array, a second nozzle array, and a third nozzle array which are arranged in the intersecting direction, the first nozzle array and the second nozzle array being arrayed to be shifted in the nozzle-arrayed direction, and each nozzle belonging to the second nozzle array being arrayed in intervals between two adjacent nozzles belonging to the first nozzle array in the nozzle-arrayed direction, said apparatus comprising:

an adjusting operating unit configured to execute an operation for adjusting relative printing positions between the first nozzle array and the second nozzle array in the intersecting direction;

a first print control unit configured to control the first nozzle array and the second nozzle array to discharge inks to form a plurality of first patterns on the printing medium such that each dot printed on the printing medium by ink discharged from the each nozzle belonging to the second nozzle array is formed, in the nozzle-arrayed direction, between two adjacent dots printed on the printing medium by ink discharged from the two adjacent nozzles belonging to the first nozzle array, wherein, before the plurality of first patterns is formed, the relative printing positions between the first nozzle array and the second nozzle array in the intersecting direction are adjusted by the adjusting operating unit;

a second print control unit configured to control the third nozzle array to discharge inks to form a plurality of second patterns on the printing medium, wherein the plurality of second patterns corresponds to the plurality of first patterns, some of the plurality of second patterns are shifted so as to overlap with the corresponding first patterns in the intersecting direction, and the overlap amounts in the intersecting direction differ from each other; and an obtaining unit configured to obtain an adjustment value with reference to the plurality of first patterns and the plurality of second patterns, for adjusting the relative printing positions between the first nozzle array and the third nozzle array in the intersecting direction.

2. The apparatus according to claim 1, wherein the first nozzle array and the second nozzle array are arrayed in a single chip.

3. The apparatus according to claim 1, wherein when printing positions between a plurality of nozzle arrays corresponding to different ink colors are adjusted, the adjustment value is calculated.

4. The apparatus according to claim 1, further comprising an input unit configured to input information from a user, wherein said obtaining unit obtains the adjustment value based on information input, via said input unit, by the user who refers to the plurality of first patterns and the plurality of second patterns.

5. The apparatus according to claim 1, further comprising an optical sensor configured to optically read the plurality of first patterns and the plurality of second patterns formed on the printing medium, wherein said obtaining unit obtains the adjustment value based on density differences due to the differences in the overlap amounts, and wherein the density differences are based on densities of the plurality of first patterns and the plurality of second patterns obtained by the optical sensor.

6. The apparatus according to claim 5, wherein said obtaining unit obtains the adjustment value based on an approximate data, calculated by said obtaining unit, which specifies a relationship between the relative shift amounts of the some of the plurality of second patterns to the corresponding first patterns and the density of the plurality of first patterns and the plurality of second patterns.

7. The apparatus according to claim 1, wherein the first print control unit controls the first nozzle array and the second nozzle array such that the plurality of first patterns are arranged in the intersecting direction.

8. The apparatus according to claim 1, wherein the plurality of second patterns are formed on the printing medium after the plurality of first patterns are formed on the printing medium.

9. A printing apparatus which prints by discharging inks from respective nozzle arrays while moving a printhead with respect to a printing medium in an intersecting direction which intersects with a nozzle-arrayed direction, the printhead comprising a plurality of nozzle arrays including at least a first nozzle array, a second nozzle array, and a third nozzle array which are arranged in the intersecting direction, the first nozzle array and the second nozzle array being arrayed to be shifted in the nozzle-arrayed direction, and each nozzle belonging to the second nozzle array being arrayed in intervals between two adjacent nozzles belonging to the first nozzle array in the nozzle-arrayed direction, said apparatus comprising:

a first print control unit configured to control the first nozzle array and the second nozzle array to discharge inks to form a plurality of first patterns on the printing medium such that each dot printed on the printing medium by ink discharged from the each nozzle belonging to the second nozzle array is formed, in the nozzle-arrayed direction, between two adjacent dots printed on the printing medium by ink discharged from the two adjacent nozzles belonging to the first nozzle array;

a second print control unit configured to control the third nozzle array to discharge inks to form a plurality of second patterns on the printing medium, wherein the plurality of second patterns corresponds to the plurality of first patterns, some of the plurality of second patterns are shifted so as to overlap with the corresponding first patterns in the intersecting direction, and the overlap amounts in the intersecting direction differ from each other; and an obtaining unit configured to obtain an adjustment value with reference to the plurality of first patterns and the plurality of second patterns, for adjusting the relative printing positions between the first nozzle array and the third nozzle array in the intersecting direction, wherein said first print control unit sets a width in the intersecting direction of a pattern formed by the second nozzle array to be shorter than a width in the intersecting direction of a pattern formed by the first nozzle array upon formation of the first patterns.

10. A printing position adjusting method in a printing apparatus which prints by discharging inks from respective nozzle arrays while relatively moving a printhead with respect to a printing medium in an intersecting direction which intersects with a nozzle-arrayed direction, the printhead comprising a plurality of nozzle arrays including at least a first nozzle array, a second nozzle array, and a third nozzle array which are arranged in the intersecting direction, the first nozzle array and the second nozzle array being arrayed to be shifted in the nozzle-arrayed direction, and each nozzle belonging to the second nozzle array being arrayed in intervals between two adjacent nozzles belonging to the first nozzle array in the nozzle-arrayed direction, the method comprising the steps of:

executing an operation for adjusting relative printing positions between the first nozzle array and the second nozzle array in the intersecting direction;

controlling the first nozzle array and the second nozzle array to discharge inks to form a plurality of first patterns on the printing medium, such that each dot printed on the printing medium by ink discharged from the each nozzles belonging to the second nozzle array is formed, in the nozzle-arrayed direction, between two adjacent dots printed on the printing medium by ink discharged from the two adjacent nozzles belong to the first nozzle array, wherein, before the plurality of first patterns is formed, the relative printing positions between the first nozzle array and the second nozzle array in the intersecting direction are adjusted in the executing step;

controlling the third nozzle array to discharge inks to form a plurality of second patterns on the printing medium, wherein the plurality of second patterns correspond to the plurality of first patterns, some of the plurality of second patterns are shifted so as to overlap with the corresponding first patterns in the intersecting direction, and the overlap amounts in the intersecting direction differ from each other; and obtaining an adjustment value with reference to the plurality of first patterns and the plurality of second patterns, for adjusting the relative printing positions between the first nozzle array and the third nozzle array in the intersecting direction.

11. The method according to claim 10, wherein in the controlling the first nozzle array and the second nozzle array, the plurality of first patterns are arranged in the intersecting direction.

12. A printing position adjusting method in a printing apparatus which prints by discharging inks from respective nozzle arrays while relatively moving a printhead with respect to a printing medium in an intersecting direction which intersects with a nozzle-arrayed direction, the printhead comprising a plurality of nozzle arrays including at least a first nozzle array, a second nozzle array, and a third nozzle array which are arranged in the intersecting direction, the first nozzle array and the second nozzle array being arrayed to be shifted in the nozzle-arrayed direction, and each nozzle belonging to the second nozzle array being arrayed in intervals between two adjacent nozzles belonging to the first nozzle array in the nozzle-arrayed direction, the method comprising the steps of:

controlling the first nozzle array and the second nozzle array to discharge inks to form a plurality of first patterns on the printing medium, such that each dot printed on the printing medium by ink discharged from the each nozzles belonging to the second nozzle array is formed, in the nozzle-arrayed direction, between two adjacent dots printed on the printing medium by ink discharged from the two adjacent nozzles belong to the first nozzle array;

controlling the third nozzle array to discharge inks to form a plurality of second patterns on the printing medium, wherein the plurality of second patterns correspond to the plurality of first patterns, some of the plurality of second patterns are shifted so as to overlap with the corresponding first patterns in the intersecting direction, and the overlap amounts in the intersecting direction differ from each other; and obtaining an adjustment value with reference to the plurality of first patterns and the plurality of second patterns, for adjusting relative printing positions between the first nozzle array and the third nozzle array in the intersecting direction, wherein, in the controlling the first nozzle array and the second nozzle array step, a width in the intersecting direction of a pattern formed by the second nozzle array is set to be shorter than a width in the intersecting direction of a pattern formed by the first nozzle array upon formation of the first patterns.

* * * * *